US012509869B2

(12) United States Patent
Townes

(10) Patent No.: US 12,509,869 B2
(45) Date of Patent: Dec. 30, 2025

(54) HUMAN WASTE PROPULSION SYSTEM

(71) Applicant: Floosh, Inc., Knoxville, TN (US)

(72) Inventor: Mark G. Townes, Knoxville, TN (US)

(73) Assignee: Floosh, Inc., Knoxville, TN (US)

( * ) Notice: Subject to any disclaimer, the term of this patent is extended or adjusted under 35 U.S.C. 154(b) by 201 days.

(21) Appl. No.: 18/302,921

(22) Filed: Apr. 19, 2023

(65) Prior Publication Data

US 2023/0349138 A1 Nov. 2, 2023

Related U.S. Application Data

(60) Provisional application No. 63/492,668, filed on Mar. 28, 2023, provisional application No. 63/341,471, (Continued)

(51) Int. Cl.
*E03D 3/10* (2006.01)
*E03D 11/11* (2006.01)

(52) U.S. Cl.
CPC ..... *E03D 3/10* (2013.01); *E03D 11/11* (2013.01)

(58) Field of Classification Search
CPC ..... B60R 15/00–04; E03D 11/10; E03D 3/00; E03D 3/10; E03D 5/01; E03D 5/012; E03D 5/024; E03F 1/006–008
See application file for complete search history.

(56) References Cited

U.S. PATENT DOCUMENTS 2,315,824 A 4/1943 Sweeny
2,449,442 A * 9/1948 Agra ..... E03D 5/00 4/433

(Continued)

FOREIGN PATENT DOCUMENTS

DE 102004042147 * 3/2006 ..... E03F 1/006
KR 2010087966 * 8/2010 ..... E03F 5/14
NL 9500487 A 10/1996

OTHER PUBLICATIONS

International Search Report and Written Opinion of the International Searching Authority; Issued in related PCT Application No. PCT/US2023/066199; Document issue date: Aug. 28, 2023; 17 pages.

(Continued)

*Primary Examiner* — David P Angwin
*Assistant Examiner* — Nicholas A Ros
(74) *Attorney, Agent, or Firm* — Peter L. Brewer; Thrive IP

(57) ABSTRACT

A hydraulic propulsion system for disposing of human waste. The system includes a toilet having a bowl, and a base below the bowl. The base is secured to the chassis of a vehicle, or to a remote sanitation facility. The system also comprises a hydraulic flushing mechanism associated with the toilet, and a fluid receiving chamber that receives water and human waste when the flushing mechanism is actuated. The human waste is directed through a sewage ejection pipe and into a black-water tank or a municipal sewer system. The human waste propulsion system further comprises a pneumatic line. The pneumatic line is in fluid communication with the fluid receiving chamber proximate the bowl. The pneumatic line receives compressed air which is delivered when the hydraulic flushing mechanism is actuated. Additionally, the human waste propulsion system has a controller. The controller is configured to close a flush valve and then direct the compressed air into the pneumatic line when the flushing mechanism is actuated, thereby moving human waste through the fluid receiving chamber.

15 Claims, 21 Drawing Sheets

Related U.S. Application Data filed on May 13, 2022, provisional application No. 63/337,498, filed on May 2, 2022.

(56) References Cited

U.S. PATENT DOCUMENTS 3,154,796 A 11/1964 Bruce
3,214,772 A 11/1965 Roberts et al.
3,566,415 A 3/1971 Culp
3,643,265 A 2/1972 Wiswell, Jr.
3,698,019 A 10/1972 Culp
3,720,962 A * 3/1973 Harrah ..... E03D 3/00 4/431
3,730,884 A * 5/1973 Burns ..... E03F 1/007 4/321
3,732,579 A 5/1973 Allander et al.
3,930,755 A * 1/1976 Lahr ..... F04F 1/06 417/318
3,968,526 A 7/1976 Harrah
3,996,628 A 12/1976 Mollerstedt
4,041,554 A 8/1977 Gregory et al.
4,156,297 A * 5/1979 Pilolla ..... B61D 35/007 4/321
4,232,409 A 11/1980 Van Pham
4,286,342 A * 9/1981 Anthony ..... E03D 11/10 4/441
4,357,719 A 11/1982 Badger et al.
4,510,629 A 4/1985 Jovy et al.
4,546,502 A 10/1985 Lew
4,621,379 A 11/1986 Kilpi
4,791,688 A 12/1988 Krishnakumar et al.
4,928,326 A 5/1990 Olin et al.
4,955,921 A 9/1990 Basile et al.
4,999,859 A 3/1991 Bolze et al.
5,005,226 A 4/1991 Basile et al.
5,007,117 A 4/1991 Oldfelt et al.
5,406,652 A 4/1995 Hennessy
5,553,333 A 9/1996 Andersson
5,575,304 A 11/1996 Hassett
6,401,270 B1 6/2002 Moore
6,467,497 B1 * 10/2002 Stradinger ..... E03F 1/006 406/16
6,804,840 B2 * 10/2004 Berman ..... E03D 5/012 4/434
10,422,117 B2 * 9/2019 Getmann ..... E03F 1/006
2003/0229939 A1 12/2003 Berman
2009/0077731 A1 3/2009 Hiranuma et al.
2010/0252489 A1 10/2010 Takemura et al.
2011/0004990 A1 1/2011 Leitao
2018/0023596 A1 1/2018 Fox
2021/0108401 A1 4/2021 Carter

OTHER PUBLICATIONS

Machine Translation of Abstract for NL 9500487; Inventor: Arnoldus Nicolaas Maria Voort; Published: Oct. 1, 1996; 1 page.

* cited by examiner

HUMAN WASTE PROPULSION SYSTEM

STATEMENT OF RELATED APPLICATIONS

This application claims the benefit of U.S. Ser. No. 63/337,498 entitled "Human Waste Propulsion System." That application was filed on May 2, 2022.

This application also claims the benefit of U.S. Ser. No. 63/334,471 entitled "Human Waste Propulsion System." That application was filed on May 13, 2022.

This application also claims the benefit of U.S. Ser. No. 63/492,668 entitled "Human Waste Propulsion System." That application was filed on Mar. 28, 2023.

Each of these prior applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of human waste management systems. More specifically, the present invention relates to the efficient removal of human waste from one or more toilets using a pneumatic propulsion system. The present invention further relates to the management of human waste in low-water applications such as within recreational vehicles or in unsewered applications such as remote portable toilet facilities.

Discussion of Technology

The collection and treatment of raw sewage is at the nexus of many economic and environmental concerns. In large cities and in more advanced countries, human excreta is mixed with water in order to hydraulically transport the excreta to a water treatment plant. Typically, the water treatment plant is a municipal water treatment facility where the water is separated from the excreta, sanitized, and returned to the water system as potable water. Excess water may be returned to the environment.

The infrastructure required for such treatment systems is an expected part of an advanced society. However, for remote towns and developing countries the management of human waste may be cost prohibitive. This can create both health problems and environmental concerns. It is estimated that one third of the world's population does not have access to adequate sanitation infrastructure.

Beyond developing world infrastructure challenges, there are many sewage producing instances where direct fluidic connection to a waste treatment process is not available. These may be referred to as unsewered applications. In these instances the raw sewage must be collected and stored—awaiting future disposition.

In unsewered areas, current sanitation approaches tend to focus on inexpensive, near-zero water use systems. This may include the use of stand-alone outdoor toilets or the use of portable human waste systems, also referred to colloquially as port-a-potties. Such toilet units may be fabricated by mechanically fastening large plastic panels (or, optionally, acrylic panels) which together comprise a floor, three walls, a roof and a door. Such systems may include the co-location of micro-treatment processes such as in-situ biological treatment.

One form of unsewered, or no-flush toilets is referred to as container-based sanitation (CBS). CBS refers to a sanitation system where simple, gravity-drop toilets collect human excreta in sealable, removable containers. The containers are periodically collected and transported to treatment facilities, then replaced within the CBS for future collections.

No-flush sanitation systems can be found in off-grid housing (or so-called man camps), military field installations, remote parks, and natural disaster/refugee camps. In these instances, direct fluidic connection to a waste treatment process is not available. Such instances typically employ CBS and/or micro-treatment processes. In all the above examples, limiting the amount of water mixed with excreta, and therefore stored, transported, and ultimately treated—or dumped into the environment—is critical.

There is, of course, a universal disdain for sewage sights and smells. The modern ceramic bowl, flushing toilet experience mitigates both—and is universally preferred. Residential and commercial toilets also utilize a so-called P-trap. Water, and ultimately waste, from the toilet does not make a straight line to the drain; instead, the waste moves through a U-shaped bend in the pipe directly below the bowl. The bend is dimensioned to retain a small volume of water after a flush of the toilet is completed. This serves to prevent odors in the drain from moving back up into the bowl and its wash room. In some instances, the residential or commercial toilet has an internal S-trap which performs the same function but requires a higher volume of water.

No-flush and low-flush portable toilet systems do not offer this water-retention, bent-piping feature. In these toilets, the water content is so low that the toilets must sit directly over a waste tank and "gravity drop" the waste. There are products and chemicals available on the market designed to minimize odors rising up from the waste tank; however, in all cases the waste tanks must be periodically emptied, cleaned, chemically dosed, and otherwise maintained to both reduce their waste levels and mitigate the odors.

Low-flush sanitation systems may be used in connection with toilets that are placed within RVs, airplanes, boats, and buses. In these instances, the toilet is connected to a plumbing system which includes potable water and a black-water tank. A clean flush may require only one to three pints of water in order to move the waste from the bowl into the appropriate discharge tank. Note that in comparison, residential and commercial toilets require a minimum of 1.28 gallons per flush to fluidize and transport the waste through the sewer system.

Therefore, reduced water-consumption flushing toilet technology has been at the forefront of development efforts. These efforts have produced vacuum toilet systems and waste macerator/pumping toilet systems. However, the best development efforts to date have been burdened by some combination of expense, complexity, susceptibility to clogging, and odor production.

It is noted that RV type gravity drop toilet systems are the most water efficient. These systems can provide users with the desired ceramic bowl, flushing toilet experience, while using as little as one U.S. pint of water per flush. However, there is no design flexibility in the placement of waste tanks as the waste tanks are required to reside in the undercarriage of the RV as a so-called black-water tank. Those of ordinary skill in the art will understand that the waste tanks can be punctured by road debris. In addition, when the RV is exposed to cold temperatures, the holding tanks must be insulated and/or heated during use, and drained during freezing conditions when the RV is not in use. Boats and other vehicles face a similar issue of inflexibility in waste tank placement, the potential for damage due to puncture, and exposure to outside ambient temperatures. Gravity drop toilets are also notorious for foul odor production as the valve that opens to drop waste into the black water tank also allows sewer gas to escape into interior living spaces.

Accordingly, a need exists for an improved human waste disposal system suitable for a recreational (or other mobile) vehicle. In addition, a need exists for a human waste propulsion system that can be used to rapidly remove waste from a toilet associated with either a maritime vessel or a bottom drain from an RV or other vehicle. Further yet, a need exists for a human waste propulsion system that may be incorporated into a substantially stationary structure that is not plumbed into a municipal sewage system.

Additionally, a need exists for a flushing system that will enable the more practical use of a low water, flushing toilet in unsewered applications—whether mobile, portable, or stationary. In addition, the need exists for a low water, flushing toilet system that can effectively serve as the front end waste collection device for a CBS application. Additionally, the need exists for a system that can propel low water toilet waste a significant horizontal and/or vertical distance for storage or additional processing. Finally, the need exists for a low water flushing system that resists clogging by flushed articles that might otherwise disable macerator- and vacuum-type flushing systems.

SUMMARY OF THE INVENTION

A propulsion system for disposing of human waste is provided. In a first embodiment, the propulsion system is designed to reside on a vehicle or vessel. Examples of a vehicle include a passenger bus, a recreational vehicle, or a rail car. Examples of a vessel include a passenger boat (such as a yacht), or a large airplane.

The vehicle or vessel includes a plumbing system and an electrical system. As part of the plumbing system, one or more potable water tanks is provided. In addition, one or more gray-water tanks is provided. Further still, a black water tank is provided.

In one embodiment, the human waste propulsion system first includes a toilet. The toilet has a bowl, and a seat residing above the bowl. Additionally, the toilet has a base. The base is secured to the chassis of the vehicle or the framing of the vessel. A flush valve resides below the bowl within the base.

The waste propulsion system also comprises a hydraulic flushing mechanism. The hydraulic flushing mechanism is associated with the toilet. Preferably, the flushing mechanism is a foot pedal pivotally secured to the base of the toilet. Depressing the foot pedal will open a valve below the bowl and cause water to move through the bowl. In one aspect, as long as the foot pedal is depressed, water will be released for flushing into the bowl and the flush valve will remain open.

The waste propulsion system also includes a bottom drain. The bottom drain serves as a fluid receiving chamber. The fluid receiving chamber is fluidically connected to the toilet below the bowl. The fluid receiving chamber is configured to gravitationally receive human waste that passes through the flush valve during a flushing event.

In one aspect, the fluid receiving chamber includes a U-shaped profile below the bowl. A release pipe (sometimes referred to herein as an elongated release portion or sewage ejection pipe) extends up from the U-shaped profile, and is configured to release the human waste into a black-water tank when the flushing mechanism is actuated. Preferably, the black-water tank is situated "above grade," meaning that the black-water tank resides one to five feet above a level of the toilet, with the release pipe delivering waste into a top of the black-water tank.

In a preferred aspect, the fluid receiving chamber comprises an upper receiving end upstream of the U-shaped profile. The sewage ejection pipe resides primarily downstream of the U-shaped profile; the sewage ejection pipe extends to a height above the seat; and a diameter of the upper receiving end is approximately twice the size of a diameter of the sewage ejection pipe. The U-shaped profile may include an eccentric reducer that transitions the larger upper receiving end to the smaller sewage ejection pipe.

The waste propulsion system further comprises a pneumatic line. The pneumatic line is in fluid communication with the fluid receiving chamber proximate the bowl, but below the flush valve. The pneumatic line receives air provided by a source of compressed air. The source of compressed air may be an air tank or an air compressor. In the case of an air compressor, the air compressor is preferably powered by an on-board battery associated with the vehicle or vessel.

Additionally, the waste propulsion system has a controller. The controller is configured to direct the compressed air into the pneumatic line when the flushing mechanism is actuated, thereby moving human waste through the fluid receiving chamber. The human waste is further pushed up through the release pipe and into the black-water tank by means of pneumatic pressure.

In one aspect, the pneumatic line connects to the fluid receiving chamber at a point of connection immediately below the bowl. A vent tube is fluidically connected to the fluid receiving chamber proximate the pneumatic line. In an alternate embodiment, the vent tube may be fluidically connected to the fluid receiving chamber via the pneumatic line. The vent tube may be configured to vent into the black-water tank or into the atmosphere.

In one aspect, the human waste propulsion system further comprises:

- a first solenoid valve (or vent valve) residing along the vent tube; and
- a second solenoid valve (or air valve) residing along the pneumatic line.

The vent valve is in a normally-open position, but closes in response to an electrical signal from the controller when the flushing mechanism is actuated. The air valve is in a normally-closed position, but opens in response to a signal from the controller, thereby allowing the compressed air to enter the fluid receiving chamber.

In one preferred embodiment, the controller includes a timer circuit. The controller and timer circuit are programmed to send the compressed air into the bottom drain about one second after the flushing mechanism is actuated. Stated another way, the valve sending compressed air into the fluid receiving chamber is not opened until a designated period of time after the foot pedal is released. This provides time for the valve below the bowl (the flush valve) and the valve along the vent tube to close before the pulse of compressed air hits the fluid receiving chamber.

In another arrangement, a toilet having a human waste propulsion system is associated with a remote sanitation facility. The remote sanitation facility may be, for example, a port-a-potty, a bathroom at a park or nature reserve, a so-called tiny home, or other facility not necessarily plumbed into a municipal water supply or municipal sewage line.

In this instance, the human waste propulsion system may comprise:

- a toilet having a bowl, and a seat residing above the bowl;
- a flush valve immediately below the bowl;
- a hydraulic flushing mechanism associated with the toilet;
- a fluid receiving chamber fluidically connected to the toilet below the bowl, with the fluid receiving chamber being configured to gravitationally receive human waste that passes through the flush valve;
- a pneumatic line in fluid communication with the fluid receiving chamber below the bowl;
- a source of compressed air configured to supply air to the pneumatic line under pressure; and
- a controller configured to direct a pulse of compressed air into the pneumatic line when the flushing mechanism is actuated but after the flush valve is closed, thereby moving human waste through the fluid receiving chamber.

Preferably, the human waste propulsion system further comprises:

- a fluid processing unit, wherein the fluid processing unit comprises:
  - a source of water for flushing; and
  - a black water receptacle configured to receive the human waste from the fluid receiving chamber when the flushing mechanism is actuated and the pulse of compressed air goes through the fluid receiving chamber.

DETAILED DESCRIPTION OF CERTAIN EMBODIMENTS

Definitions

For purposes of the present application, it will be understood that the term "recreational vehicle" refers to any vehicle that provides an axle with wheels, along with a chassis for supporting a bathroom, a toilet and one or more human waste tanks.

As used herein, the term "vehicle" refers to any moving passenger vehicle such as a recreational vehicle, a passenger bus, a subway car, or a rail car.

As used herein, the term "vessel" refers to any maritime vessel such as a passenger boat, a tour boat, or a yacht. The term vessel may also refer to a passenger airplane.

As used herein, the term "flushing event" comprises a user activating a flushing mechanism, followed by the opening of the flush valve below the toilet bowl and water being released into the bowl to move human waste into a fluid release chamber, followed by the closing of the flush valve, followed by the opening of a solenoid valve along the pneumatic line causing a pulse of compressed air to be released from an air compressor (or compressed air tank) through the pneumatic line and into the fluid receiving chamber below the flush valve, followed by human waste being expelled (such as into a black-water tank), followed by the re-closing of the solenoid valve along the pneumatic line.

As used herein, the term "gray-water" refers to water that contains substantially clean waste water from baths, sinks, appliances, and the like. Gray-water does not contain human or animal waste.

As used herein, the term "black water" refers to water that contains human or animal waste. A black water tank is a container used to receive and hold black water.

As used herein, the term "fresh water" refers to potable water or water from a municipal source.

DESCRIPTION OF SPECIFIC EMBODIMENTS

The present disclosure relates to a human waste propulsion system. More specifically, a human waste propulsion system that relies upon a thrust of air pressure to move human waste from a toilet is provided. The toilet may reside on a vehicle such as a passenger bus, a tour bus, or a recreational vehicle. Alternatively, the toilet may reside on an airplane or a maritime vessel. Alternatively still, the toilet may be a part of a portable toilet unit, or a collection of portable toilet units that share a common human waste propulsion system.

Figure 1:
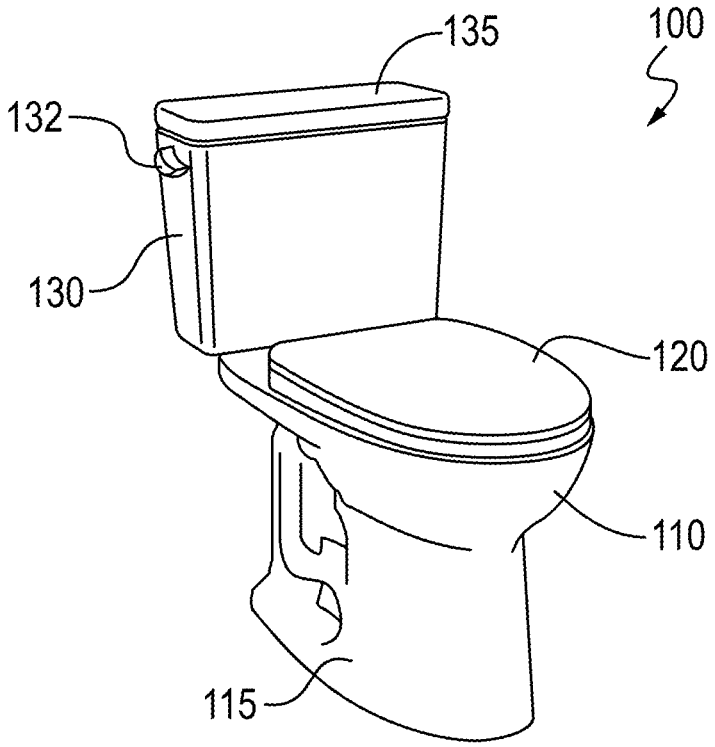
FIG. 1 (Prior Art)
FIG. 1 is a perspective view of a known toilet. This particular toilet uses a tank that is filled with water between flushes.

FIG. 1 is a perspective view of a known toilet 100. This particular toilet 100 uses a tank 130 that is filled with water between flushes. The toilet 100 has a bowl 110, and a base 115 below the bowl 110. A lever 132 is provided in order to actuate a flushing mechanism. The toilet 100 includes a hinged lid 120 over the bowl 110. The toilet 100 also includes a removable lid 135 over the tank 130.

The toilet 100 is considered a high-water use toilet. Such a toilet 100 is common in commercial and residential bathrooms in developed countries.

Figure 2:
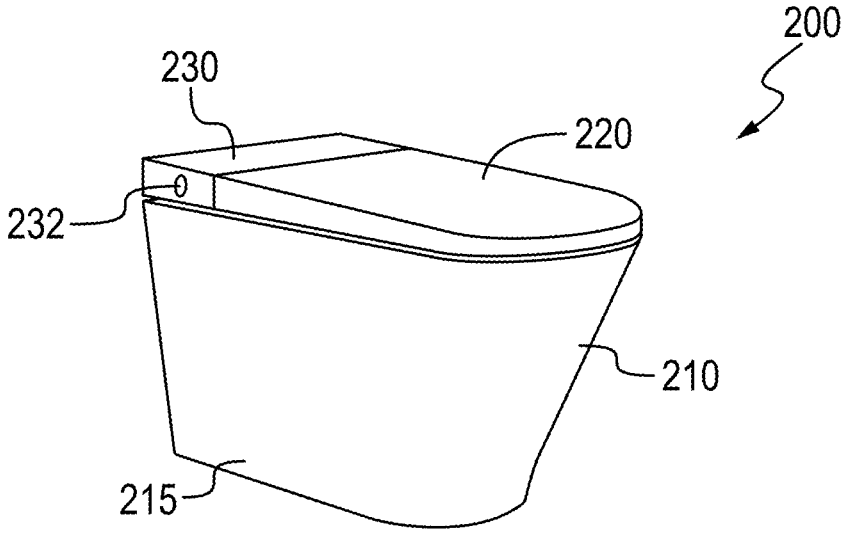
FIG. 2 (Prior Art)
FIG. 2 is a perspective view of another known toilet. This toilet is a tankless toilet, and receives water from a plumbed pipe during flushes.

FIG. 2 is a perspective view of another known toilet 200. This toilet 200 is a tankless toilet, and receives water from a plumbed pipe (not shown) during flushes. The toilet 200 has a bowl 210, and a base 215 below the bowl 210. A push-button 232 is provided in order to actuate flushes. The toilet 200 includes a hinged lid 220 over the bowl 210. The toilet 200 also includes a removable lid 230 to access internal plumbing components of the toilet 200.

The toilet 200 is also considered a high-water use toilet. Such a toilet 200 is common in commercial and residential bathrooms in developed countries, particularly in smaller bathrooms such as in apartment buildings.

Figure 3A:
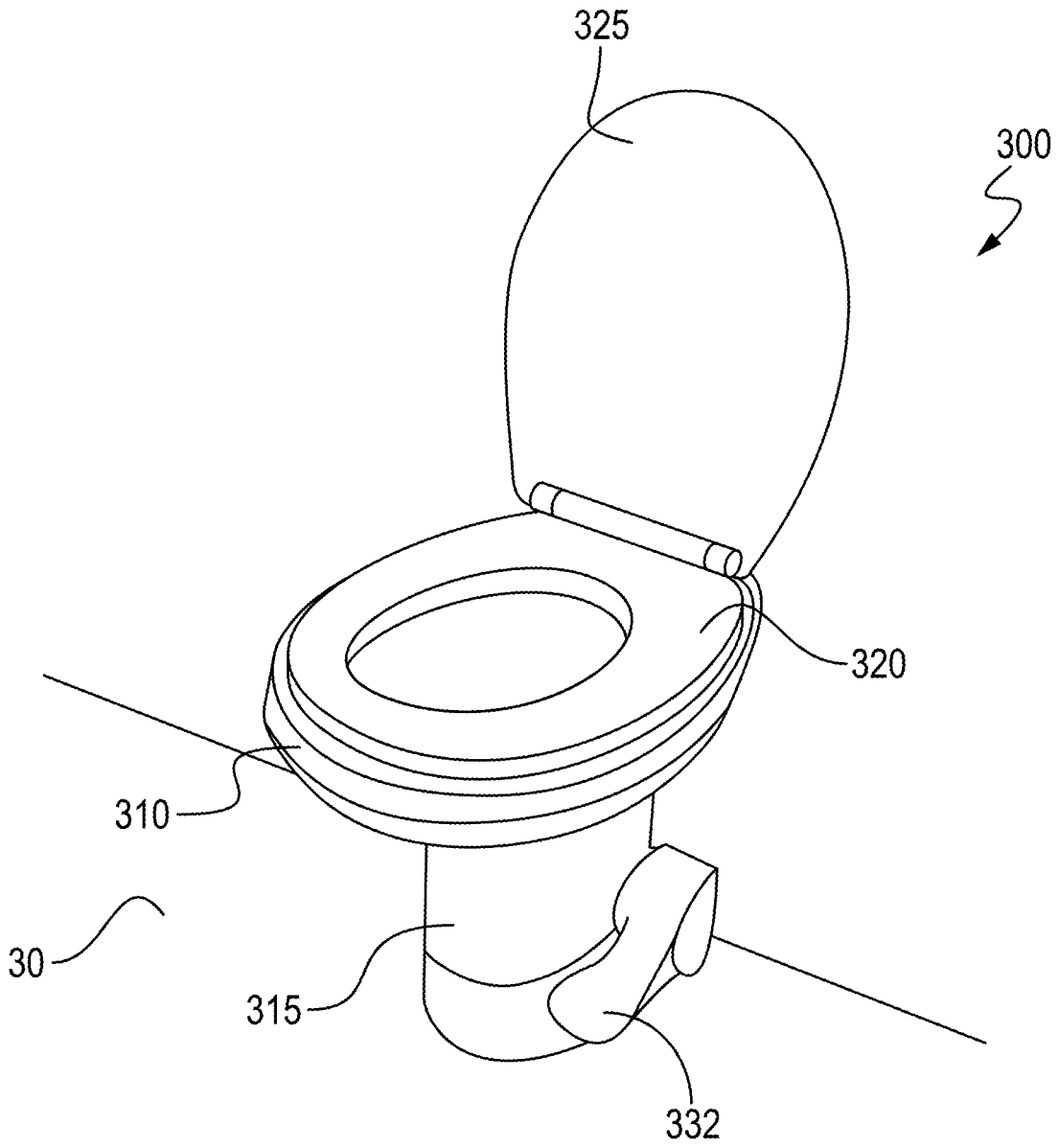
FIG. 3A is a front perspective view of a toilet as may be used with a human waste propulsion system of the present disclosure, in one embodiment. The toilet may be used with a recreational vehicle or other travel vehicle, or with a boat. Alternatively, the toilet may be used with any fixed or portable toilet not otherwise plumbed into a sewage system.

FIG. 3A is a first perspective view of a toilet 300 as may be used with the human waste propulsion system of the present invention, in one embodiment. In this instance, the toilet 300 is designed to be used with a recreational vehicle ("RV") or other travel vehicle. Alternatively, the toilet 300 may be placed in a portable sanitation unit. In any instance, the toilet 300 is intended for low-water use.

It can be seen that the toilet 300 includes a bowl 310, and a seat 320 supported by the bowl 310. The bowl 310 may be constructed from any of several media such as plastic, porcelain, acrylic, fiberglass, or ceramic. The seat 320 may be fixedly or removably attachable to the bowl 310 and may pivot from a point located on the bowl 310. In either instance, the seat 320 is supported by the bowl 310, which may be removably or fixedly attached to a mount.

The toilet 300 also includes a base 315. The base 315 is supported by a flooring 30. The flooring 30 may be an actual floor, or may be a decking on a boat or RV. A drain (not shown) is formed through the flooring 30 and receives human waste when the toilet 300 is flushed. The drain is in fluid communication with a black-water tank (not shown).

It can also be seen that the toilet 300 includes a flushing mechanism. The flushing mechanism may be a handle, a button, or other hydro-mechanical device used to initiate a flushing of water into the bowl 310. In this particular instance, the flushing mechanism is a foot pedal 332. The foot pedal 332 is pivotally secured to the base 315 of the toilet 300.

Water is delivered into the bowl 310 in response to a user depressing the pedal 332 with his or her foot. A water line (visible at 337 in FIG. 6A) feeds water into the bowl 310 through a valve (shown at 335 of FIG. 6A) associated with the foot pedal 332. The water may originate from a potable water tank (not shown). A typical flush may inject 1 quart (0.95 liter) of water into the bowl 310. Alternatively, a flush may inject 1.5 quarts (1.42 liters), or 2.0 quarts (1.89 liters) of water into the bowl 330.

Figure 3B:
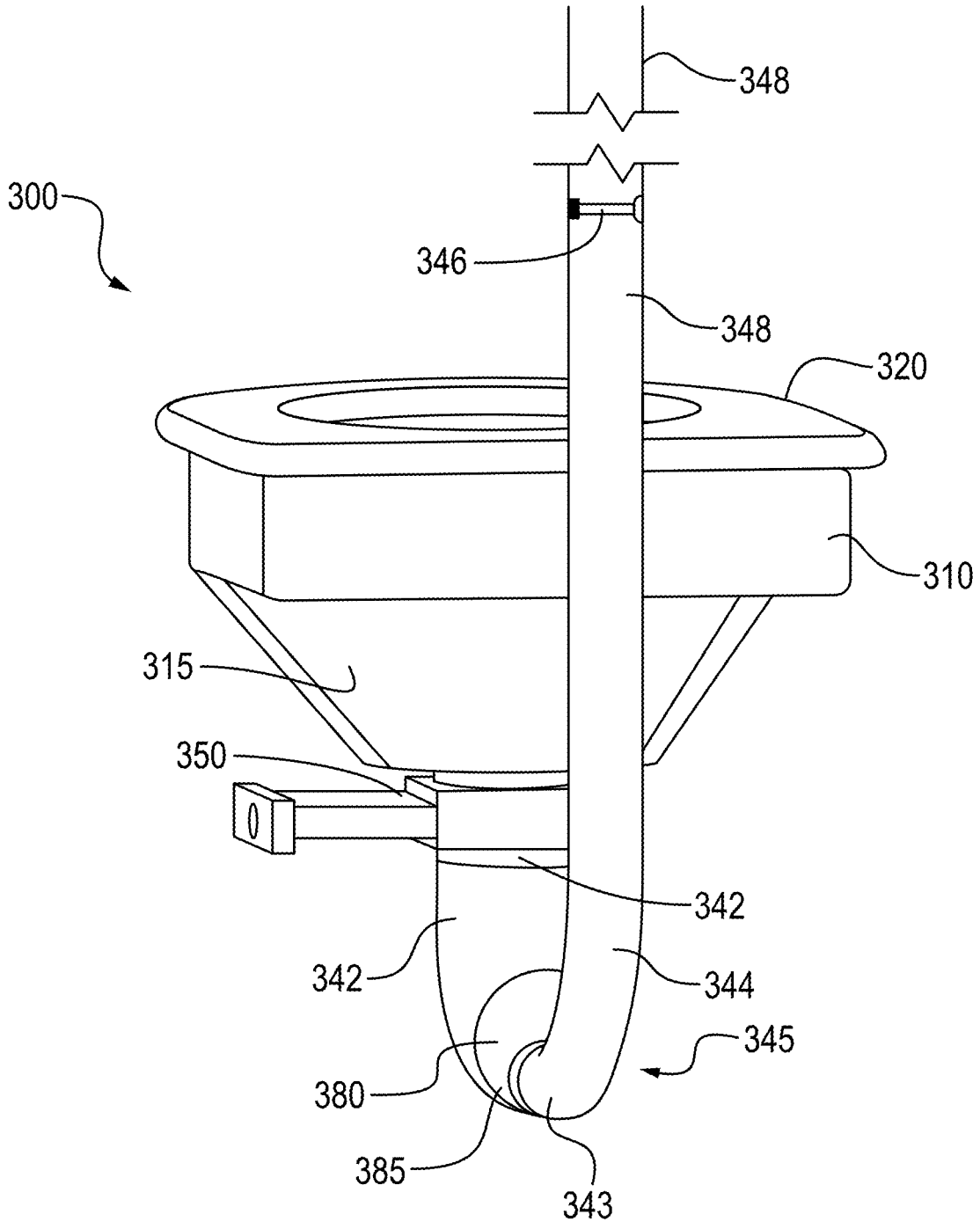
FIG. 3B is a first schematic diagram view of the toilet of FIG. 3A, seen from a back side of the toilet. Here, a fluid receiving chamber can be seen, connecting to a waste drain, or fluid receiving chamber. Also visible is a flush valve used to control the flushing of waste into the fluid receiving chamber.

FIG. 3B is a first schematic view of the toilet 300 of FIG. 3A. The view is seen from a back side of the toilet 300. It can be seen that a bottom drain 380 resides below the bowl 110. The bottom drain 380 may be referred to as a fluid receiving chamber. The fluid receiving chamber 380 is designed to receive human waste from the bowl 310 in response to a flushing event.

The fluid receiving chamber 380 is preferably configured to have a U-shaped profile 345. The U-shaped profile portion 345 resides below an input side, representing an upper pipe section 342. Intermediate the bowl 310 and the input side 342 is a flush valve 350. The flush valve 350 is preferably a gate valve. The flush valve 350 opens automatically in response to an electrical actuation signal sent when the foot pedal 332 is depressed. The flush valve 350 then closes according to the setting of a timer circuit. Alternatively, the flush valve 350 remains open for so long as the foot pedal 332 is depressed.

The input side 342 of the fluid receiving chamber may consist of a 3" diameter, 90-degree, long sweep elbow pipe. The horizontal portion of the 3" elbow pipe can be extended to optimize the fluid volume in the fluid receiving chamber 380. At its terminus, the elbow on the input side 342 connects to a 3"-to-1.5" eccentric reducer 385, the output of which is strategically located at the lowest point in the U-shape profile 345. The reducer 385 may be, for example, a T104 eccentric tank reducer (3" spigot×1.5" hub) manufactured by Valterra Products of Mission Hills, California.

The U-shape profile 345 is completed with a 90-degree, 1.5" diameter long sweep elbow pipe 343. Having completed the U-shape profile 345, the fluid receiving chamber 380 continues a vertical rise to a specified height. This may be referred to as an output side 344 for an elongated release portion 348.

Of interest, a 32" section of 3" ID pipe will hold a gallon of fluid, while a 32" section of 1.5" ID pipe will hold 1 quart. In the preferred configuration, the interior volume of the U-shaped profile 345 closely matches the volume of one flush of the toilet 300, to wit, between a pint (0.47 liters) and a quart (0.95 liters). It is anticipated that each flush will carry 1.5 pints (0.71 liters). The result is that a flushing event is accomplished through a combination of hydraulic displacement, kinetic momentum and pneumatic force.

Figure 3C:
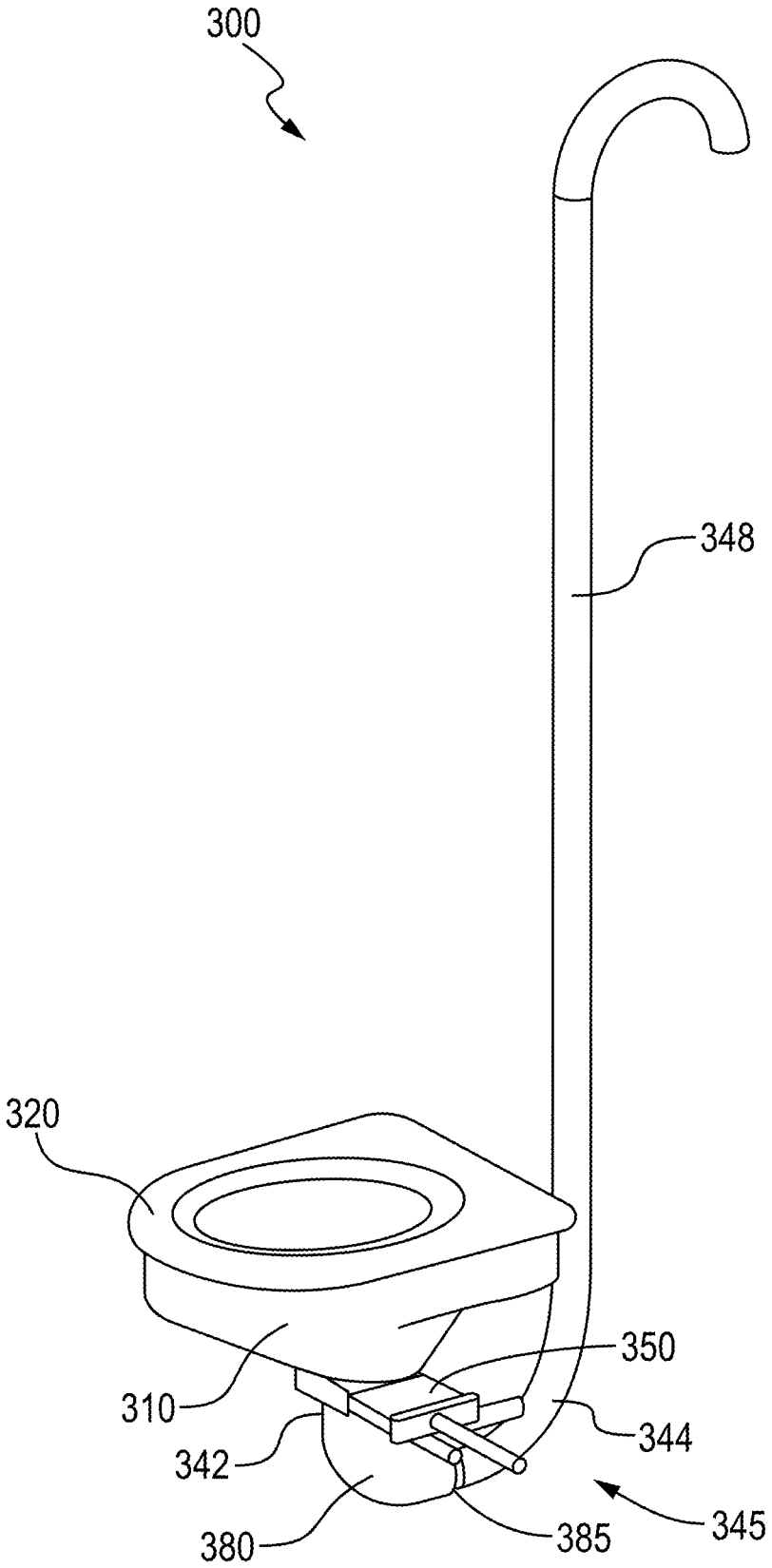
FIG. 3C is a second schematic diagram of the toilet of FIG. 3A, seen from a front perspective.

FIG. 3C is a second schematic diagram of the toilet 300 of FIG. 3A, seen from a front perspective. In this view, the elongated release portion 348 of the fluid receiving chamber 380 is visible. Of interest, the elongated release portion 348 extends upward above the bowl 310 some distance. Stated another way, the elongated release portion 348 extends above grade.

In one arrangement, the elongated release portion 348 extends upward above the bowl 110 from three to six feet. In one aspect, a check valve 346 (see in FIG. 3B) resides along the elongated release portion 348 proximate the toilet seat 320.

Also of interest, the inner diameter of the elongated release portion 348 is smaller than the inner diameter of the upper pipe section 342. In one aspect, the I.D. of the elbow on the input side 342 is 2.5 inches to 3.5 inches, while the I.D. of the elbow 343 on the output side 344 is 1.0 to 2.0 inches. Preferably, the I.D. of the reduced section of the U-shaped profile 345 and elbow 343, and the elongated release portion 348 are 1.5".

It is observed here that a standard toilet seat height is approximately 18". The total ceramic portion of the bowl is approximately 10"—leaving about 8" of clearance between the bottom of the bowl and the mounting base. For the toilet 300, the 3" diameter, long sweep 90-degree elbow 342 plus the flush valve 350 fit into this space, providing the required volume to hold up to one standard flush volume, as needed.

When human waste is expelled through the fluid receiving chamber 380, it is released through the elongated release portion 348 and into a black-water tank (not shown). The black-water tank may be adjacent the toilet 300, or may be offset. In one aspect, the black-water tank is above grade, meaning that it is positioned one to five feet above a level of the base of the flooring 60 (shown in FIG. 6A at 60).

Figure 4A:
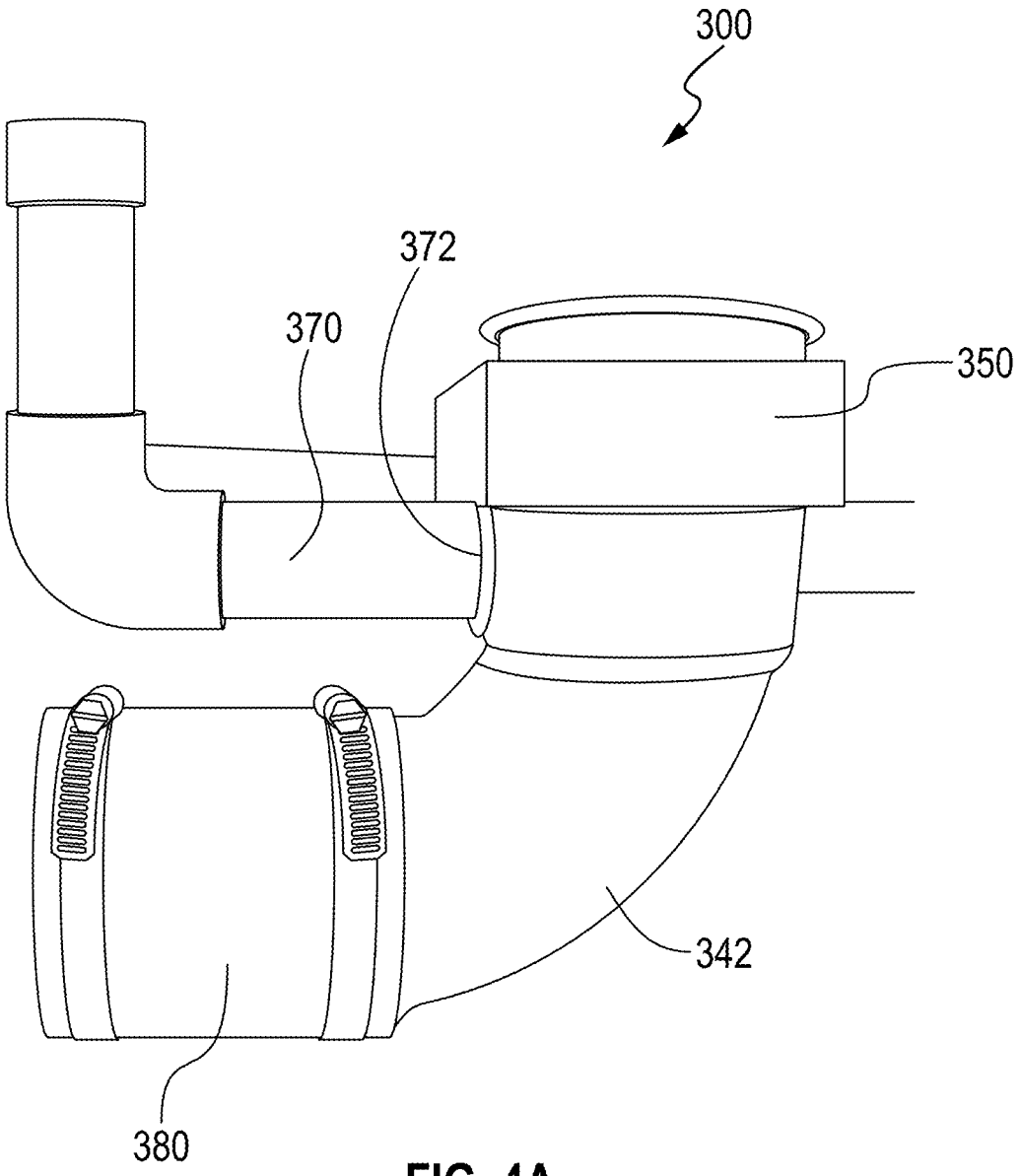
FIG. 4A is a first photographic view of an under-portion of the toilet of FIG. 3A. Here, the fluid receiving chamber is more clearly seen. Also visible is a vent tube residing between the flush valve and the fluid receiving chamber.

FIG. 4A is a first perspective view of the under-portion of the toilet 300 of FIG. 3A. Here, the fluid receiving chamber 380 is more clearly seen. Specifically, the first 90-degree, 3" elbow 342 is visible. Also visible is a vent tube 370. The vent tube 370 is in fluid communication with the fluid receiving chamber 380. Specifically, the vent tube 370 feeds into the upper pipe section (or first 90-degree elbow) 342 at a proximal end 372.

The purpose of the vent tube 370 is to vent the fluid receiving chamber 380 during flushing and, optionally, to release gaseous fluids from the fluid receiving chamber 380 between flushes. To this end, the vent tube has a distal end 376 that extends to a location either within the RV or external to the RV but remote from the toilet 300. Locations within the RV to which the distal end 376 may include an outlet vent to the atmosphere connectable to an external port of the RV or other travel vehicle. Locations external to the RV to which the distal end 376 may lead include, but are not limited to, holding tanks, fixed waste receptacles, and campsite connections, also known as "hookups."

Figure 4B:
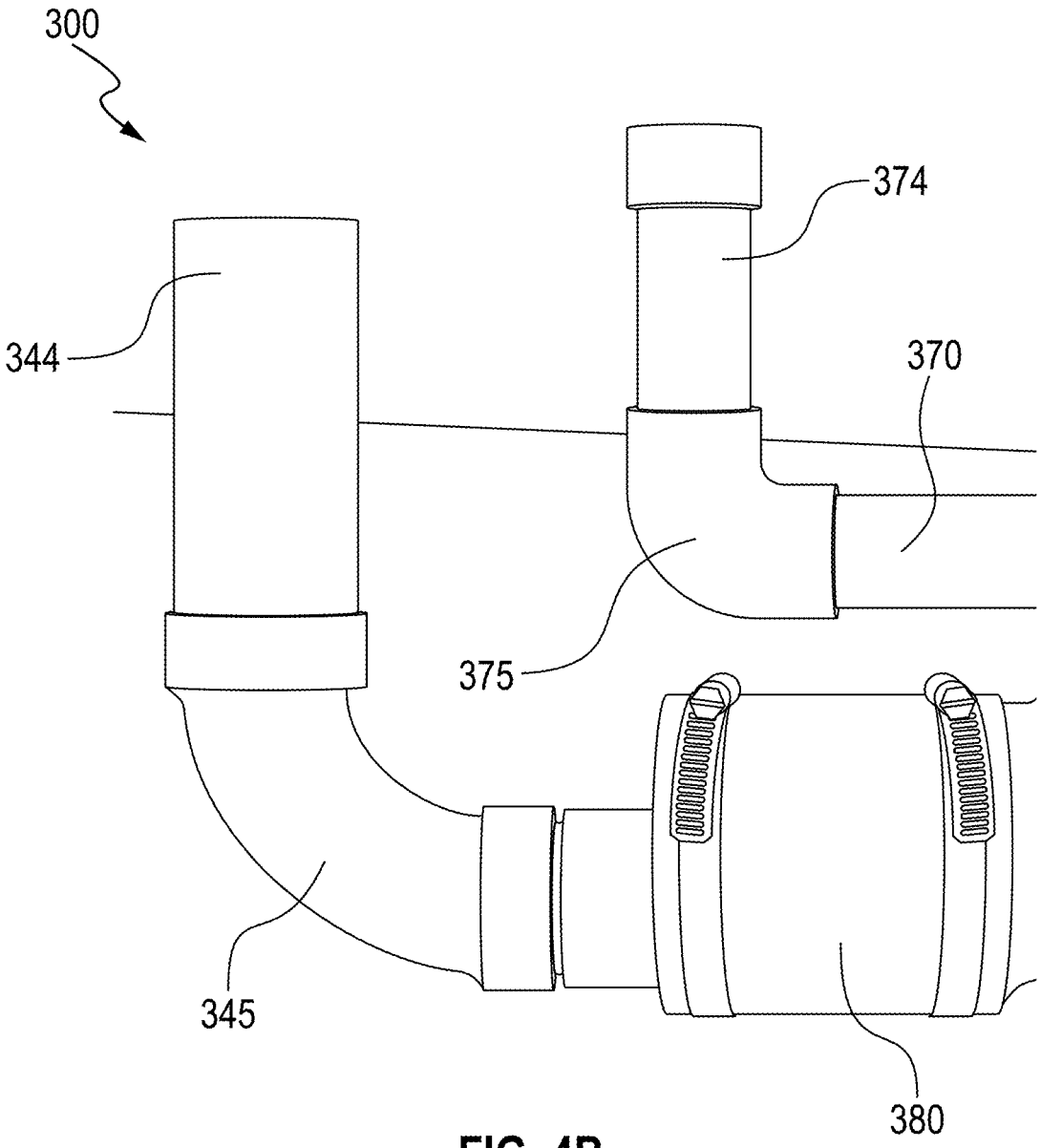
FIG. 4B is a second photographic view of the under-portion of the toilet of FIG. 3A. Here, a portion of the fluid receiving chamber and a portion of the vent tube are again seen.

FIG. 4B is a second perspective view of the under-portion of the toilet 300 of FIG. 3A. Here, the fluid receiving chamber 380 and the vent tube 370 are seen together. It is observed that the vent tube 370 includes an elbow joint 375 for directing gases to an elongated release portion 374 that leads to a location away from the toilet 300. Similarly, the U-shaped profile 345 of the fluid receiving chamber 380 (and its second 90-degree elbow 343) leads to the elongated release portion 344.

Both the elongated release portion 374 and the elongated release portion 344 serve as outlets for their respective containments. The elongated release portion 374 may be utilized to release gaseous fluids from the system to the atmosphere or into the black-water tank. The elongated release portion 344 may be utilized to discharge the human waste from the system to a location within the RV, preferably, the black-water tank.

Figure 4C:
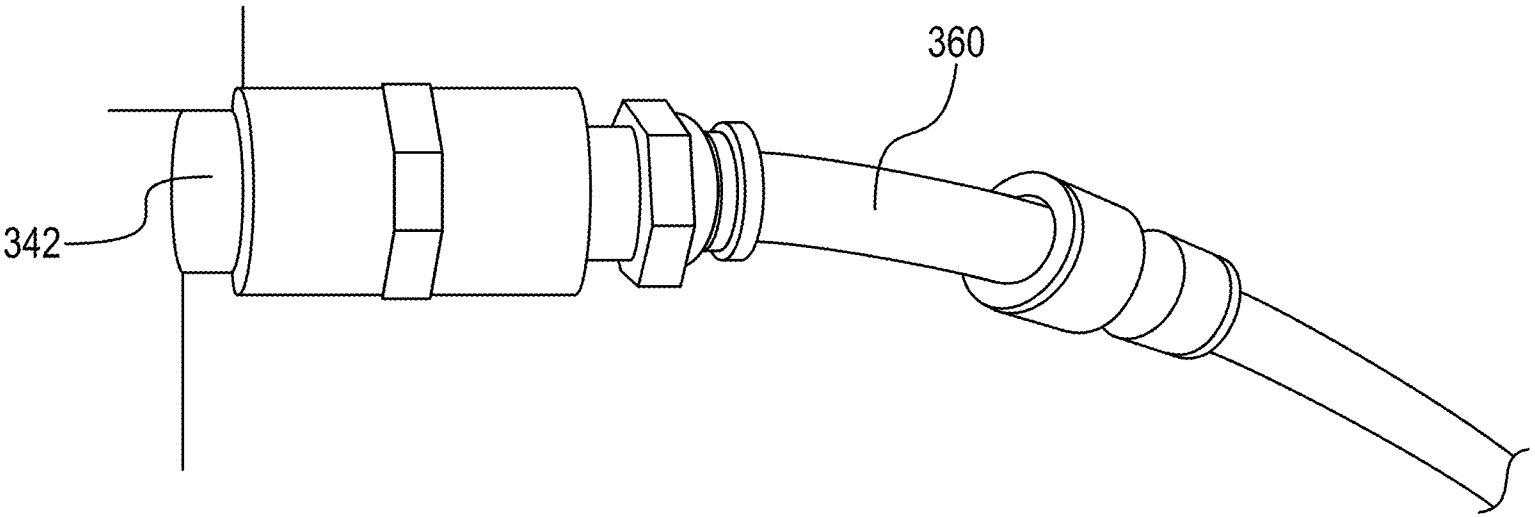
FIG. 4C is a third photographic view of the under-portion of the toilet of FIG. 3A. Here, an air hose (or pneumatic line) is visible, which feeds into a connection point intermediate the flush valve and the fluid receiving chamber.

FIG. 4C is a third perspective view of the under-portion of the toilet 300 of FIG. 3A. Here, a pneumatic line 360 is visible. The pneumatic line 360 feeds into the upper pipe section 342.

Figure 5:
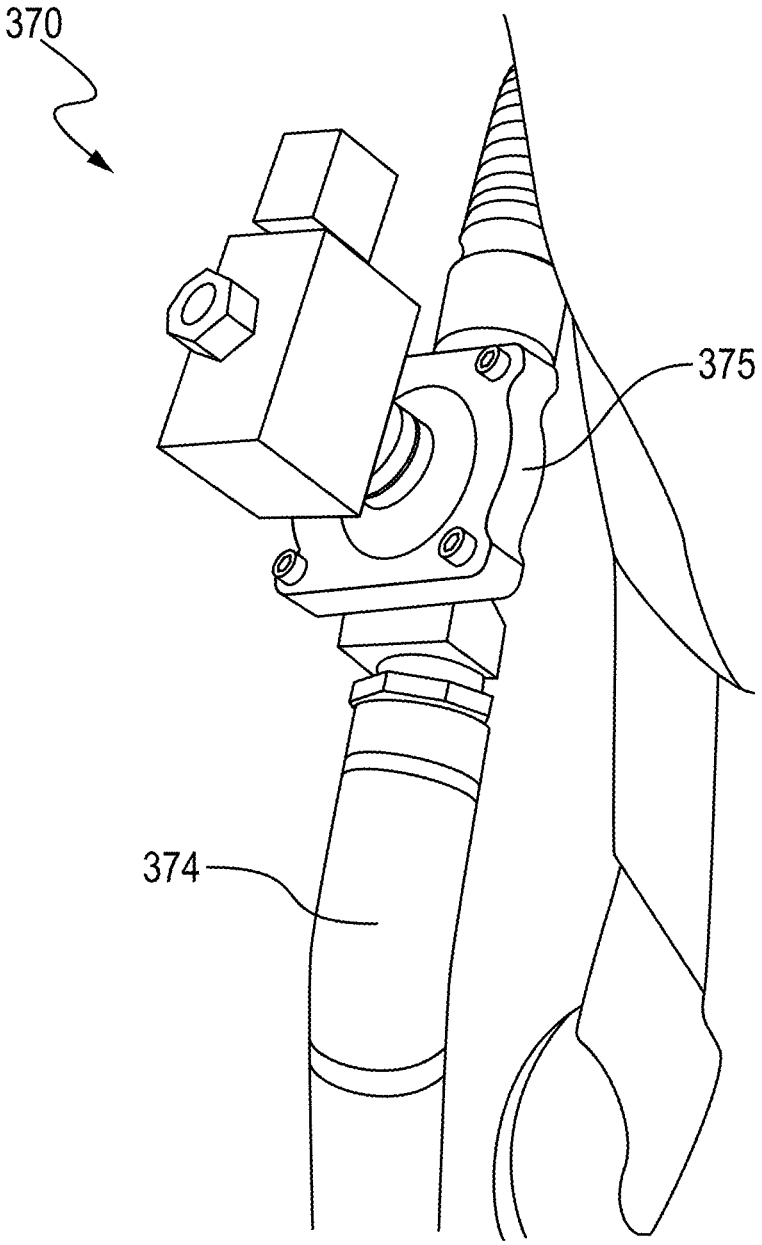
FIG. 5 is a depiction of a solenoid valve placed along the vent tube. The solenoid valve receives electrical signals from a controller.

FIG. 5 is a perspective view of the vent tube 370 of FIG. 4A. The vent tube 370 is configured to release air from the fluid receiving chamber 380 between flushing events. In this view, a solenoid valve 375 is seen along the vent tube 370. The solenoid valve 375 may be of the normally open variety to permit the venting of gaseous fluids during periods of non-flushing. Depending on the location of the solenoid valve 375, the solenoid valve 375 may remain open during the entirety of a flushing event, or it may receive an electrical signal from a controller (shown at 690 in FIG. 6A) after waste has dropped into the fluid receiving chamber 380, causing the solenoid valve 375 to close during ejection of waste. After the flushing event, an electrical signal will be sent to return the solenoid valve 375 to its normally-open state.

Figure 6A:
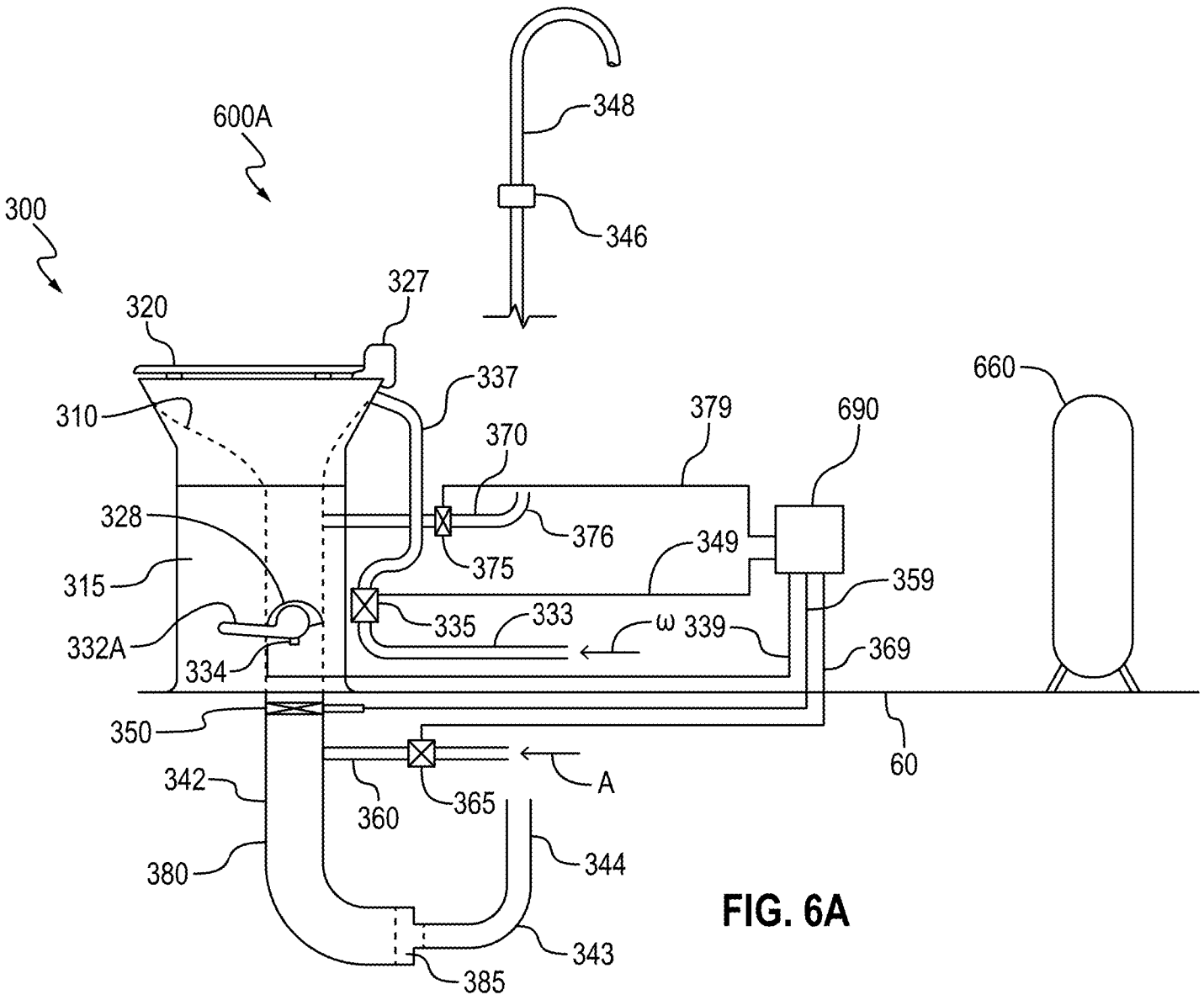
FIG. 6A is a schematic view of a human waste propulsion system of the present invention, in a first embodiment. Here, the fluid receiving chamber resides below a flooring, or deck.

FIG. 6A is a schematic view of a human waste propulsion system 600A of the present invention, in a first embodiment. Here, the fluid receiving chamber 380 resides below a flooring, or deck 60.

Visible in FIG. 6A is toilet 300. The toilet 300 again includes a bowl 310 and a base 315 residing below the bowl 310. A seat 320 resides over the bowl 310. The seat 320 is hingedly connected to a mounting 327.

The base 315 of the toilet 300 rests on the floor 60. Extending below the floor 60 is the fluid receiving chamber 380. The flush valve 350 is seen proximate the floor 60. Also residing proximate the floor 60 is a foot pedal 332A. In this instance, the foot pedal 332A serves as a flushing mechanism for the toilet 300.

Associated with the foot pedal 332A is a flush sensor 334. When the foot pedal 332A is activated (i.e., depressed by a user), the flush sensor 334 sends a signal to a controller 690. The controller 690 then sends a series of signals as follows:

First, a water valve 335, which resides along water line 333 is opened. This allows water to flow through water line 333 and into the bowl 310. Water enters water line 333 according to Arrow W. Water preferably is sourced from a potable water tank (not shown). Optionally, the water may be supplied from an external fresh water source such as a municipal water supply.

In one aspect, the water valve 335 remains open for so long as the sensor 334 senses that the foot pedal 332A is depressed. Once the flush sensor 334 senses that the foot pedal 332A is no longer depressed, a signal is sent from the controller 690 to close the water valve 335. Closing the water valve 335 stops the flow of water through the water line 333 and into the bowl 310.

In another aspect, the controller 690 is in communication with a timer, or clock. The controller 690 will not send a signal to close the water valve 335 until a certain pre-set time has elapsed, such as 3 seconds. This allows the user to momentarily depress and release the foot pedal 332A to effectuate the flushing event. Further, the timer allows for a pre-determined amount of water to enter the bowl 310 through the water line 333 and eliminates the need for the user to continually depress the foot pedal 332A.

In yet another aspect, the water valve 335 is in operative mechanical communication with the foot pedal 332A2. Depressing the foot pedal 332A will move a cam which in turn opens the water valve 335. In this instance, the water valve 335 will remain open only for as long as the foot pedal 332A is depressed.

In still another aspect, the foot pedal 332A is also in operative mechanical communication with a ball valve 382. The ball valve 382 is separate from the water valve 350 and resides adjacent the foot pedal 332A but within the upper pipe section 342 or otherwise immediately below the bowl 310. The ball valve 382 resides in a normally-closed position and seals off the bowl 310 from the upper pipe section 342. Depressing the foot pedal 332A will rotate a shaft within the upper pipe section 342 that is connected to the ball valve 382. This serves to move the ball valve 382 into an open position, allowing water and human waste to move down towards the flush valve 350. Releasing the foot pedal 332 closes both the ball valve 382 and the water valve 335.

In any event, as soon as the flush sensor 334 senses that the foot pedal 332A has been depressed, the controller 690 will send a signal that opens the flush valve 350. Preferably, the controller 690 will keep the flush valve 350 open until a pre-set time after the water valve 335 is closed. This ensures that all water and human waste are dropped out of the bowl 310 before the flush valve 350 closes. A suitable time may be 2 seconds. Alternatively, in the mechanical arrangement, the user will simply hold the foot pedal 332A until all human waste is removed from the bowl 310.

Third, a vent valve 375 optionally resides along the vent 370. The vent valve 375 is normally-open; however, when the foot pedal 332A is depressed, the controller 690 sends a signal to close the vent valve 375. The vent valve 375 will remain closed for a brief period of time, e.g., 1.0 second. Closing the vent valve 375 ensures that human waste is not expelled through the vent tube 370 during the flushing event. However, the vent valve 375 should be quickly re-opened to allow waste to move through the bottom drain 380 without creating a vacuum above the upper pipe section 342. It is again noted that the vent valve 375 is optional and it is expected that the human waste propulsion system 600A will function fine without it.

Fourth, as soon as the flush valve 350 closes, the controller 690 opens an air valve 365. The air valve 365 resides along a pneumatic line 360. The pneumatic line 360 feeds into the upper pipe section 342 of the fluid receiving chamber 380 below the flush valve 350. The feeding of air is shown at Arrow A. Air may be fed into the pneumatic line 360 from an air compressor (not shown). More preferably, air is fed into the pneumatic line 360 from a compressed air tank 660.

In FIG. 6A, a series of lines are shown. The lines are intended to be communications lines. These lines include:

Line 339 connecting the flush sensor 334 to the controller 690;

Line 349 connecting the water valve 335 to the controller 690;

Line 359 connecting the flush valve 350 to the controller 690;

Line 369 connecting the air valve 365 to the controller 690; and

Line 379 connecting the vent valve 375 to the controller 690.

It is understood that these lines 339, 349, 359, 369, 379 may be physical electrical wires or data cables. Alternatively, they may be representative of wireless signals sent by a transceiver (not shown) associated with the controller 690.

Using the lines 339, 349, 359, 369, 379 the controller 690 is able to control the human waste propulsion system 600A during flushing events. Preferably, the controller 690 is a programmable logic controller, or PLC. The controller 690 is used to identify the position of the valves 335, 350, 365 and 375 and components within the system, and control the timing of the associated events that comprise the flushing event.

Figure 6B:
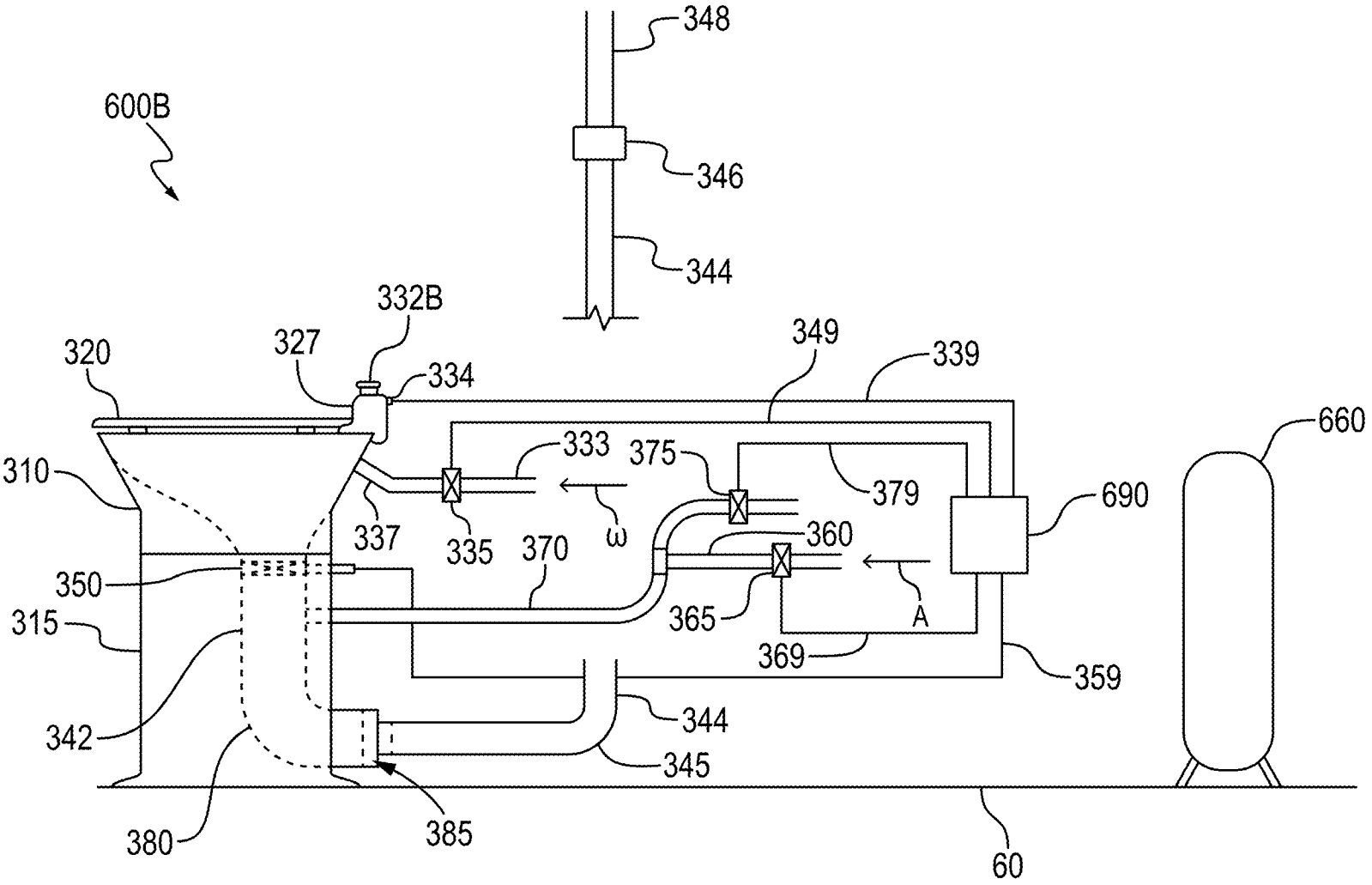
FIG. 6B is a schematic view of a human waste propulsion system of the present invention, in a second embodiment. Here, the fluid receiving chamber resides above a flooring, or deck.

FIG. 6B is a schematic view of a human waste propulsion system 600B of the present invention, in a second embodiment. Here, the fluid receiving chamber 380 resides above the flooring, or deck 60.

Visible in FIG. 6A is toilet 300. The toilet 300 again includes a bowl 310 and a base 315 residing below the bowl 310. The base 315 is again resting on the floor 60. A seat 320 resides over the bowl 310. The seat 320 is hingedly connected to a mounting 327.

Of interest, the flushing mechanism does not employ a foot pedal 332A or the connected ball valve 382; instead, a push button 332B is used. The push button 332B is shown resting on the bowl 310. However, it is understood that the push button 332B may be located along a wall, a bulkhead, or control panel (not shown) proximate the system.

A flush sensor 334 is associated with the push button 332B. When the button 332B is activated (i.e., pushed by a user), the flush sensor 334 sends a signal to the controller 690. The controller 690, in turn, sends a signal to the water valve 335 allowing water "W" to flow from water line 333, through water valve 335, into water line 337, and then into the bowl 310.

It is observed that the human waste propulsion system 600B also includes a pneumatic line 360 and a vent tube 370. However, in the arrangement of FIG. 6B, the pneumatic line 360 feeds air "A" into the vent tube 370. An air valve 365 is associated with the pneumatic line 360 while an optional vent valve 375 is associated with the vent tube 370.

As with FIG. 6A, FIG. 6B presents a series of lines, which are intended to be communications lines. These again include:

Line 339 connecting the flush sensor 334 to the controller 690;

Line 349 connecting the water valve 335 to the controller 690;

Line 359 connecting the flush valve 350 to the controller 690;

Line 369 connecting the air valve 365 to the controller 690; and

Line 379 connecting the vent valve 375 to the controller 690.

As noted, the flush valve 350 is preferably a gate valve. At the same time, the water valve 335, the air valve 365 and the vent valve 375 are preferably solenoid valves. The solenoid valves are ½" to 1" valves. The output through the air valve 365 must provide a suitable air pressure to complete the flushing event. Preferably, the output through the air valve 365 provides a valve flow coefficient of approximately 4.5, with the tool valve on the compressor showing 75 psig and the air valve 365 being open 0.5 to one second during a flush cycle. The output through the air valve 365 may be accomplished by an on-board air compressor, a compressed air storage tank, or a portable air compressor unit.

In operation, when the controller 690 receives a signal indicating that the push button 332B has been depressed, water valve 335 is opened. At the same time, flush valve 350 is also opened. Water and human waste within the bowl 310 then gravitationally flow together into the upper pipe section 342 of the fluid receiving chamber 380.

In one aspect, the water valve 335 will remain open for so long as the flush sensor 334 senses that the push button 332B is being depressed. In another aspect, the water valve 335 will remain open for a pre-selected period of time, such as 2 to 4 seconds, after the push button 332B is activated by the user.

Next, a signal is sent by the controller 690 to close the normally-open vent valve 375. Ideally, the flush valve 350 will close at this time. Shortly thereafter, such as within a second thereafter, the controller 690 sends a signal to open the normally-closed air valve 365. This directs air A through the vent tube 370 and into the fluid receiving chamber 380. The air A creates a pneumatic force that sends the water and human waste through the second U-shaped profile 345 and up the elongated release portion 348. The human waste and water is then delivered to a location away from the toilet 300, which may include a black water tank, an alternate storage tank, a campsite hookup, or other waste disposal unit. In one aspect, water and human waste are fed into an on-site, free-standing water purification system.

The vent valve 375 will remain closed for a brief period of time, and only for as long as air A is being directed into the vent tube 370 en route to the bottom drain 380. Closing the vent valve 375 ensures that air A does not retreat backwards out of the vent tube 370 (which would be the path of least pressure resistance).

Prior to the pneumatic input, the controller 690 verifies that the flush valve 350 is closed. This ensures a single path of flow for the human waste. The pulse of high pressure, compressed air A is introduced via the pneumatic line 360 and the vent tube 370, causing the human waste in the bottom drain 380 to be forced out of the fluid receiving chamber 180 and through the elongated release portion 348. The elongated release portion 348 may extend substantially higher than the bowl 310 and may discharge to a black-water tank or other holding location. Further, the elongated release portion 348 may be configured such that the human waste and water travel vertically, horizontally, or both vertically and horizontally to the location away from the toilet 300.

In one aspect, the vent valve 375 will further remain closed for an additional time as set by the clock, such as 1 to 2 seconds. This allows the air A to clear out the contents of the U-shaped profile 345. Of course, the flush valve 350 also remains closed.

In the event the user pushes the flushing mechanism (such as push button) 332B while air A is being thrust through the fluid receiving chamber 380, the controller 690 will send a signal to the air valve 365 to immediately close the air valve 365. This is true for both human waste propulsion systems 600A and 600B.

At the conclusion of each flushing event, the vent valve 375 is returned to its normally-open position by the electrical signal generated by the controller 690. The normally-open orientation of the vent valve 375 permits continual venting of the system 600A or 600B during periods of non-operation.

The U-shaped geometry of the fluid receiving chamber 380, along with the volumetric ratios of the two sides (input side or upper pipe section 342 and output side or elongated release portion 344) and a lowest point disposition of an eccentric reducer output 385, create a unique thrust for human waste when air A is injected into the fluid receiving chamber 380. The pneumatic line 360 in combination with the solenoid valve 365 and controller allows a specified volume of air A at a specified pressure to be injected into the fluid receiving chamber 380. This arrangement allows for the fluid receiving chamber 380 to remain relatively small while still accomplishing removal of human waste and water during the flushing event.

Note that a 3" diameter input side 342 of the U-shaped arrangement of the fluid receiving chamber 380 holds four times the volume of the corresponding length of a 1.5" diameter output piping 344. Therefore, during compressed air injection, the smaller diameter of the output piping 344 hydraulically displaces the fluid minimally four times the distance, with four times the velocity than within the larger pipe of the input side 342. This combination of static hydraulic displacement and high fluid velocity provides a significant motive force to the fluid—driving the fluid to a height above the check valve 346 and out of the elongated, vertical release portion 348. This allows low water-content sewage to be ejected directly into a standard height storage tank and/or, in mobile applications, obviates the need for below deck mounted holding tanks, which, as previously stated, are susceptible to freezing and puncture from road debris.

Computational modeling of fluid flow in 90-degree elbow pipes reveals a resultant maximum velocity streamline that, in lay terms, rounds the bend at the center of the elbow and then dives toward the bottom wall. For the human waste propulsion systems 600A, 600B, this means that the lowest point orientation of the eccentric reducer outlet 385 perfectly corresponds with the highest flow velocity in the 3" pipe (fluid input section 342) during a pneumatic thrust event. Furthermore, the lowest point disposition of the eccentric reducer output 385 allows maximal hydraulic displacement of fluid in the 3" pipe (fluid input section 342) before the height of the fluid surface and the top of the 1.5" exit pipe (at the point of the reducer 385) coincide—the point where the hydraulic advantage is lost as air escapes into the output side 344 of the U-shaped receiving chamber 380.

The higher velocity results in a corresponding lower pressure that, in turn, draws solids, which are mixed with the fluids, toward the center of the highest velocity streamline. The center of that streamline roughly corresponds with the center of the output pipe along the second U-profile 345—thus producing a more thorough solids evacuation of the fluid receiving chamber 380. The contents are forcefully ejected into a fluid holding container, a fluid transfer station, or a fluid processing system during the flushing event.

Figure 7A:
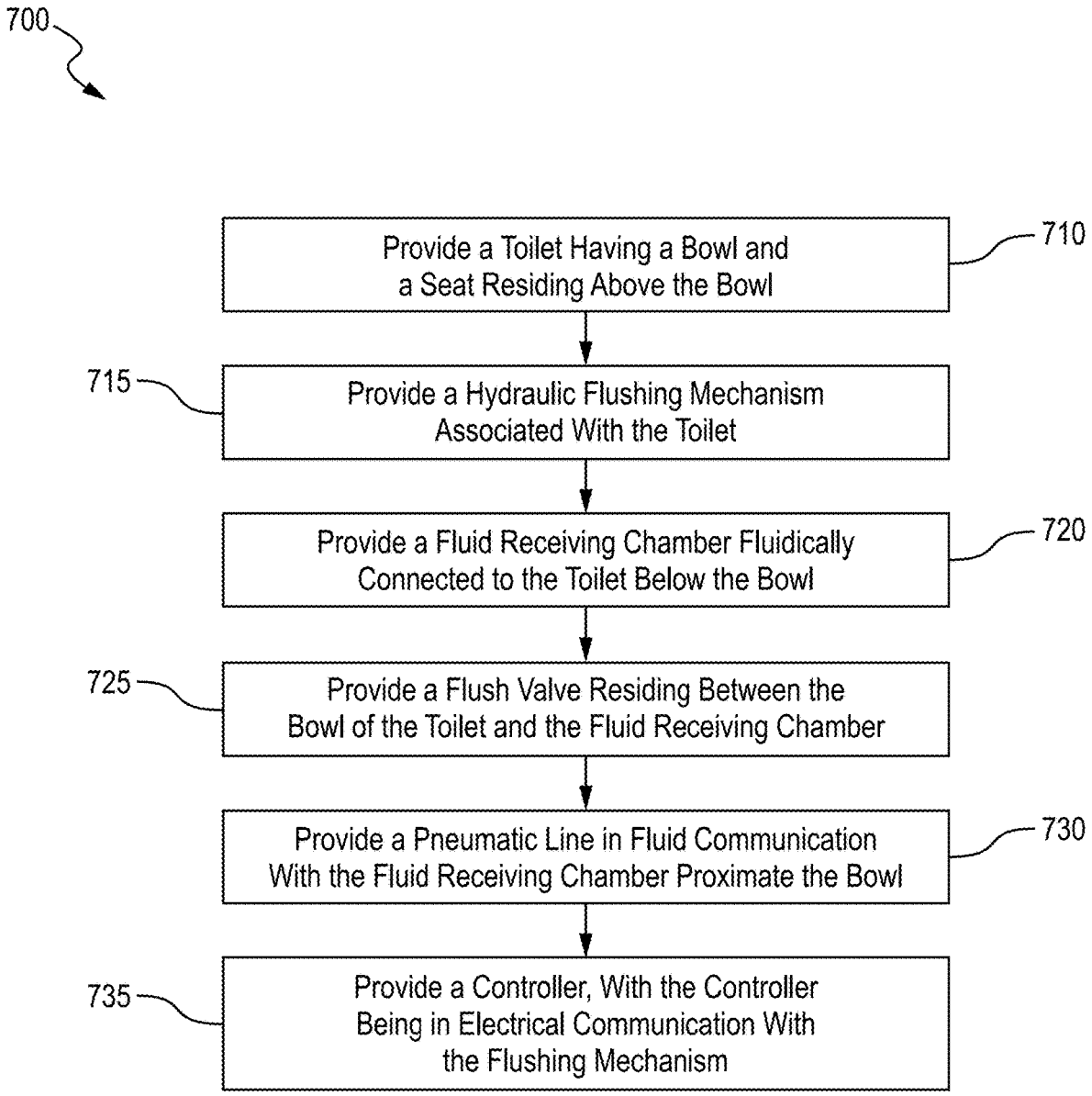
FIGS. 7A and 7B present a single flow chart showing steps for a method of ejecting human waste using a pneumatic propulsion system, in one embodiment.
Figure 7B:
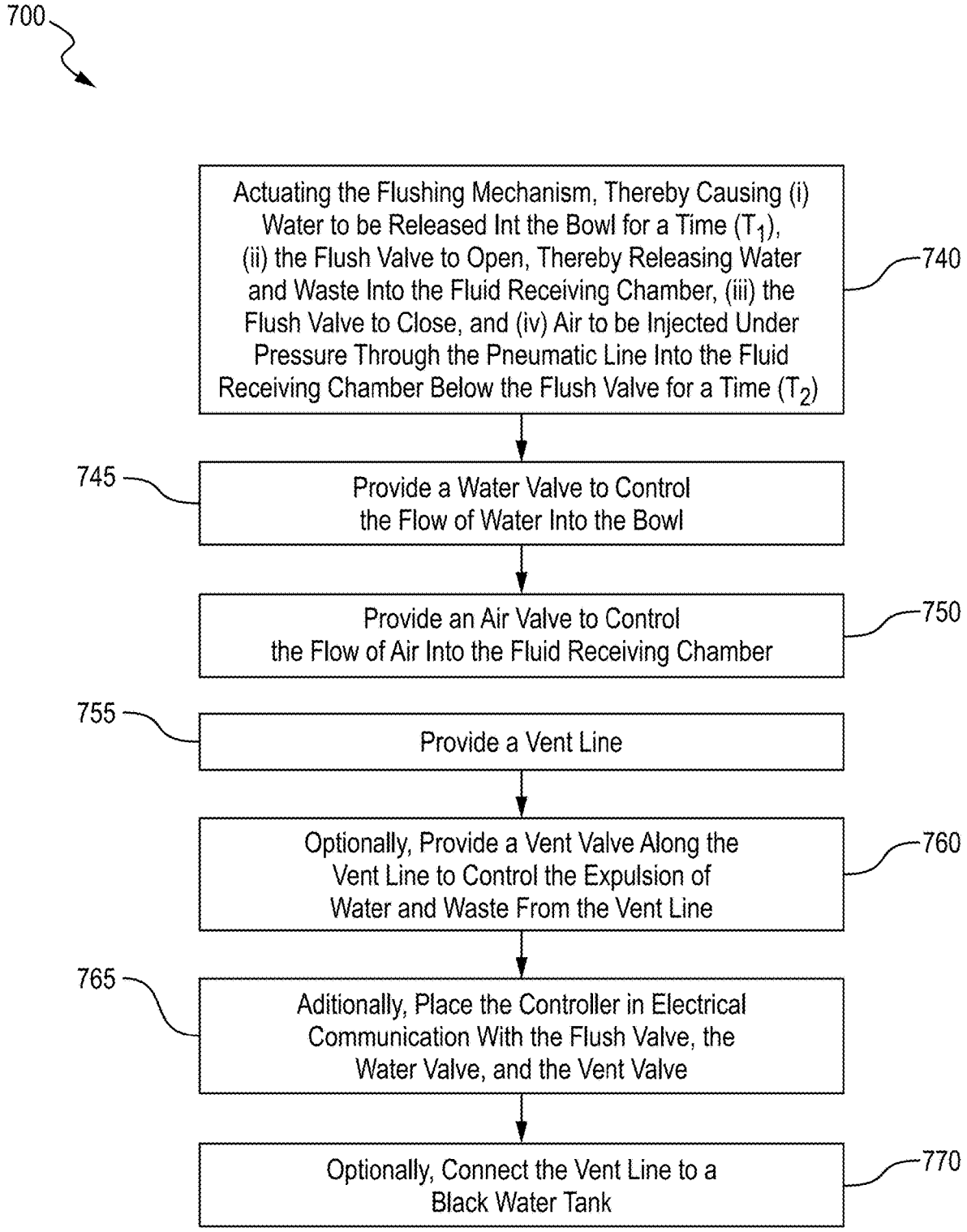

FIGS. 7A and 7B present a single flow chart showing steps for a method 700 of ejecting human waste, in one embodiment.

The method 700 first includes the step of providing a toilet. This is shown in Box 710. The toilet has a bowl, and a base supporting the bowl. In addition, the toilet includes a seat residing above the bowl. The toilet may be in accordance with the toilet 300 of any of FIGS. 3A through 3C.

The method 700 also comprises providing a hydraulic flushing mechanism. This is seen in Box 715. The hydraulic flushing mechanism is associated with the toilet. Preferably, the flushing mechanism is a foot pedal pivotally secured to the base of the toilet. Such a mechanism is shown at 332A in FIG. 6A. Depressing the foot pedal will open a flush valve 350 below the bowl and cause water to move through the bowl.

Alternatively, the flushing mechanism may be a push button, such as push button 332B of FIG. 6B. Depressing the push button will open the flush valve 350 below the bowl and cause water to move through the bowl.

The method 700 additionally includes providing a fluid receiving chamber. This is indicated at Box 720. The fluid receiving chamber is fluidically connected to the toilet below the bowl. The fluid receiving chamber may be in accordance with the U-shaped fluid chamber 380 provided in FIGS. 6A and 6B. The fluid receiving chamber may reside either above a decking, or below a decking that supports the base.

The method 700 further comprises providing a flush valve. This is provided at Box 725. The flush valve resides between the bowl of the toilet and the fluid receiving chamber. Preferably, the flush valve is a gate valve that is controlled by a controller.

The method 700 also includes providing a pneumatic line. This is shown at Box 730 of FIG. 7A. The pneumatic line is in fluid communication with the fluid receiving chamber proximate the bowl. Preferably, the pneumatic line receives air from an air compressor in response to signals from the controller. Alternatively, compressed air may be provided from a pressure vessel.

The method 700 further comprises providing a controller. This is indicated at Box 735 of FIG. 7B. The controller is in electrical communication with the flushing mechanism. Specifically, the controller sends actuation signals in response to a user actuating the flushing mechanism. Preferably, the controller is a Programmable Logic Controller, or PLC, which is capable of controlling the system, sending and receiving electrical signals, and timing events within the flushing event.

The method 700 additionally includes actuating the flushing mechanism. This is seen in Box 740. Actuating the flushing mechanism causes a series of events to take place, in sequence. These events include (i) causing water W to be injected into the bowl for a first time ($T_1$); (ii) causing the flush valve to open below the bowl, thereby releasing water W and waste into the fluid receiving chamber for at least time ($T_1$); (iii) closing the flush valve, and (iv) causing air A to be injected under pressure through the pneumatic line and into the fluid receiving chamber below the flush valve for a second designated period of time ($T_2$). Time ($T_2$) begins after time ($T_1$).

The method 700 additionally includes providing a water valve. This is shown at Box 745. The water valve resides along a water line that feeds water into the bowl. The water valve opens in response to actuation of the flushing mechanism. The water valve closes at the end of ($T_1$) and the flush valve has re-closed. In one aspect, the flushing mechanism is a foot pedal that is in operative mechanical communication with the water valve. Depressing the foot pedal simultaneously opens a ball valve below the bowl and opens the water valve. Reciprocally, releasing the foot pedal closes the ball valve and closes the water valve. In this instance, operation of the foot pedal is done during the time ($T_1$).

The method 700 also comprises providing an air valve. This is indicated at Box 750. The air valve resides along the pneumatic line that feeds air into the fluid receiving chamber. The air valve opens in response to actuation of the flushing mechanism. The air valve closes at the end of ($T_2$). Note that air is not injected into the fluid receiving chamber until after ($T_1$) has ended and the flush valve has closed.

The method 700 also includes providing a vent line. This is seen in Box 755. The vent line may tee off of the fluid receiving chamber.

The method 700 further comprises the optional step of providing a vent valve along the vent line. This is offered at Box 760. The vent valve is of a normally-open configuration, but is closed in response to electrical signals sent by the controller when the flushing mechanism is actuated. In one aspect, the vent valve will stay closed during only ($T_2$) to ensure that the human waste can be discharged to a location away from the toilet and prevent the discharge of human waste back up through the vent.

The method 700 additionally includes placing the controller in electrical communication with the various valves. This is shown at Box 765. The valves include the flush valve, the water valve, the air valve, and the vent valve. Each of these valves may comprise a solenoid that opens and closes in response to electrical signals from the controller.

Finally, the method 700 optionally comprises connecting the vent line to a black water tank. This is provided at Box 770. The black water tank is a form of storage tank, ideally used where the human waste cannot be readily pumped into a municipal sewage system or treatment facility. In one aspect, an elongated release portion propels waste some horizontal distance to the black water tank through small bore piping (i.e., on a bus, boat, or plane)—an advantage over conventional gravity-drop toilets, which are only capable of discharging waste down a vertical distance. This configuration offers tank placement flexibility and odor reduction when compared to alternate systems.

Preferably, a one-way check valve is placed along a vertical release line, downstream from the fluid receiving chamber. The check valve controls the expulsion of water and waste from the vertical release line. This allows the low-volume waste expulsion system to serve as a waste pump. Waste is pumped out of the vertical release line and into a waste container.

As can be seen, a novel waste propulsion system is provided. The human waste propulsion system in its various embodiments provides for an economical and efficient way to move low water content toilet waste an arbitrary height and/or distance away from a toilet to a storage container, a transfer station, or a sewage treatment apparatus.

The waste propulsion system has been generally described in connection with mobile applications such as within a recreational vehicle. However, there are many sewage-producing instances involving stationary applications. In such instances, direct fluidic connection to a waste treatment process is not practical or even possible. In these instances the raw sewage must be collected and stored—awaiting future disposition. Examples include toileting systems in off-grid housing (e.g., oilfield man camps or remote military camps), outdoor venues, and refugee camps. In these examples, limiting the amount of water used, and therefore stored (or dumped into the environment), is important.

FIGS. 8A through 8E present a series of self-contained sanitation systems. Each of the sanitation systems employs a toilet unit, indicated at 830. Each toilet unit 830 may be a so-called "port-a-potty," or may be a more permanent but remote installation. In any instance, the toilet unit 830 is fixed, or stationary, during use. More importantly, each toilet unit 830 employs a human waste propulsion system such as the systems 600A or 600B described above.

Figure 8A:
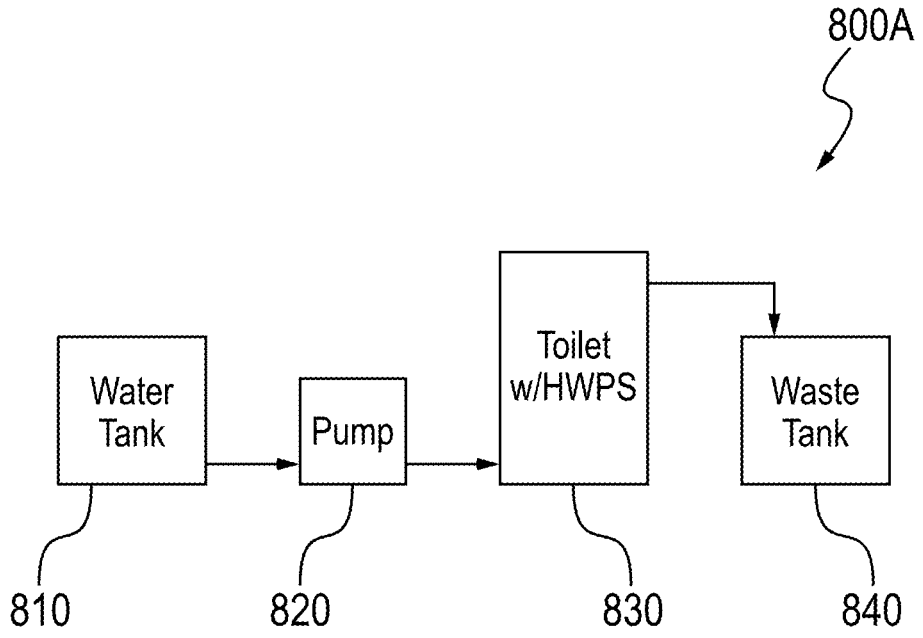
FIG. 8A is a first schematic view of a self-contained sanitation system wherein the toilet uses the human waste propulsion system of the present invention. Here, the sanitation system employs a water tank as a source of water for flushing. A waste tank is provided on-site to receive human waste after flushing.

FIG. 8A is a schematic view of a self-contained sanitation system 800A. In this arrangement, the self-contained sanitation system 800A uses an external fresh water source for flushing. In addition, the system 800A uses an on-site waste tank to receive human waste after flushing.

Referring to the system 800A, it can be seen that a water tank 810 is first provided. The water tank 810 serves as the source of fresh water for flushing. Water in the water tank 810 is drawn out by a pump 820. The pump 820, in turn, sends the fresh water into the toilet unit 830. As noted, the toilet unit 830 utilizes a human waste propulsion system such as those disclosed in systems 600A or 600B.

When the flushing mechanism (such as mechanisms 332A or 332B) is actuated, water and human waste are expelled into a waste tank 840. Preferably, the waste tank 840 is portable, meaning it can be transported and emptied into a water processing facility such as a municipal water plant.

Figure 8B:
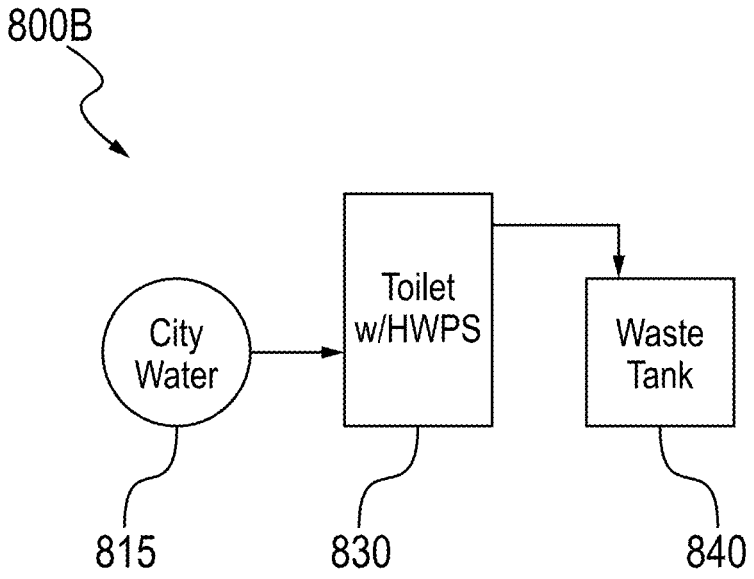
FIG. 8B is a second schematic view of a self-contained sanitation system wherein the toilet uses the human waste propulsion system of the present invention. Here, the sanitation system uses a waste tank on-site to receive human waste, but is plumbed into city water as the source of fresh water for flushing.

FIG. 8B is a schematic view of a self-contained sanitation system 800B in a second embodiment. In this case the sanitation system 800B is plumbed into a municipal water source 815, which serves as the source of potable water for flushing. The sanitation system 800B again uses a toilet unit 830 having a human waste propulsion system which may be in accordance with those disclosed in systems 600A or 600B. In addition, the system 800B employs a waste tank 840 on-site to receive human waste and waste water.

Figure 8C:
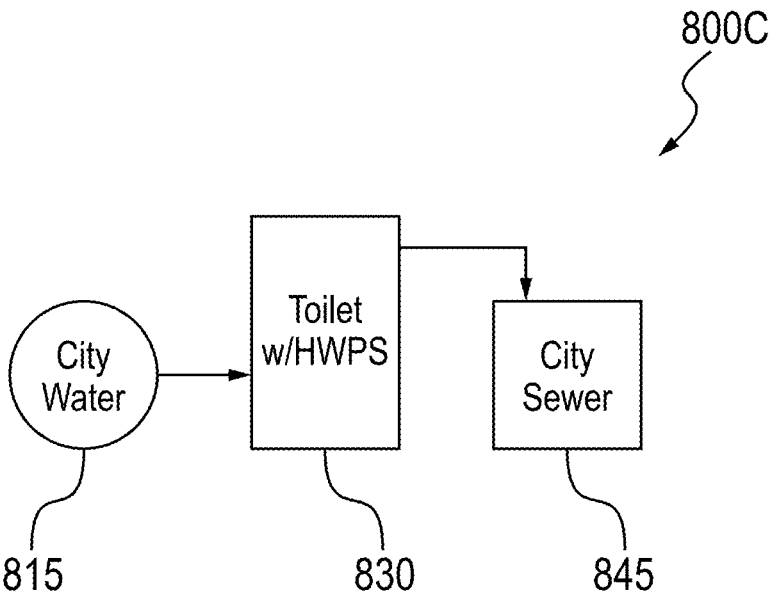
FIG. 8C is a third schematic view of a self-contained sanitation system wherein the toilet uses the human waste propulsion system of the present invention. Here, the sanitation system uses the municipal water source as the source of fresh water for flushing. The sanitation system delivers the human waste directly into the municipal sewer system upon flushing.

FIG. 8C is a schematic view of a self-contained sanitation system 800C in a third embodiment. Here, the system 800C is again plumbed into a city water grid 815 to provide potable water for flushing. In this instance, flushing the toilet unit 830 sends the human waste into the city sewer system 845. Thus, the sanitation system 800B is not entirely remote. However, the self-contained sanitation system 800C is portable in the sense that it may be transported to a location and installed into an existing municipal water supply and municipal sewer system 845.

Figure 8D:
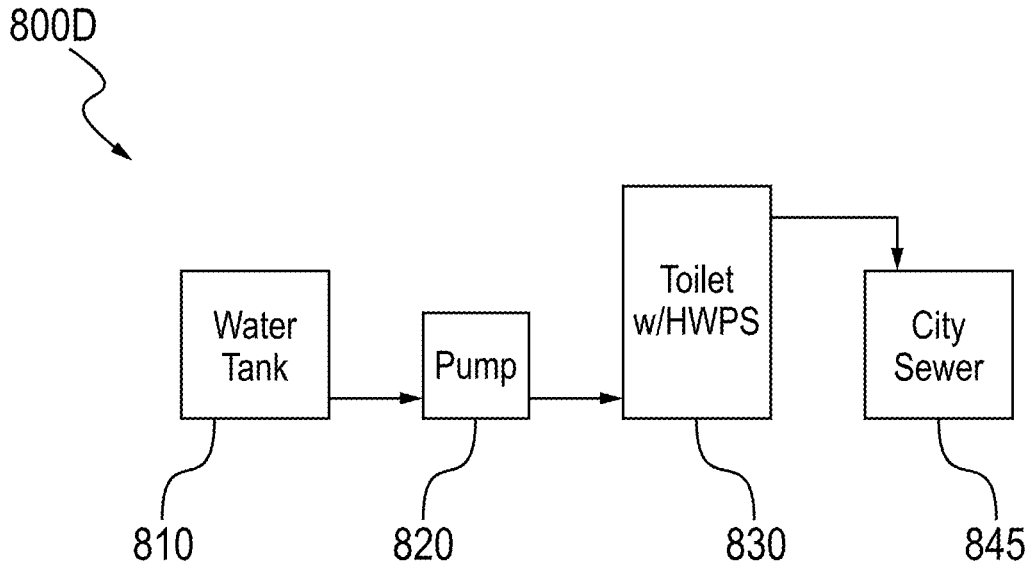
FIG. 8D is a fourth schematic view of a self-contained sanitation system wherein the toilet uses the human waste propulsion system of the present invention. Here, the sanitation system employs a water tank as a source of fresh water for flushing. Human waste is sent directly into the municipal sewer system upon flushing.

FIG. 8D is a schematic view of a self-contained sanitation system 800D in a fourth embodiment. As with the system 800A, a water tank 810 and a pump 820 are used to send water into a toilet unit 830 for flushing. In this instance, flushing the toilet unit 830 sends the human waste into the city sewer system 845. Of interest, the self-contained sanitation system 800D does not require municipal fresh water to be provided; instead, the sanitation system 800D provides for the water tank 810 and pump 820 to supply fresh water to the toilet unit 830 for flushing.

Figure 8E:
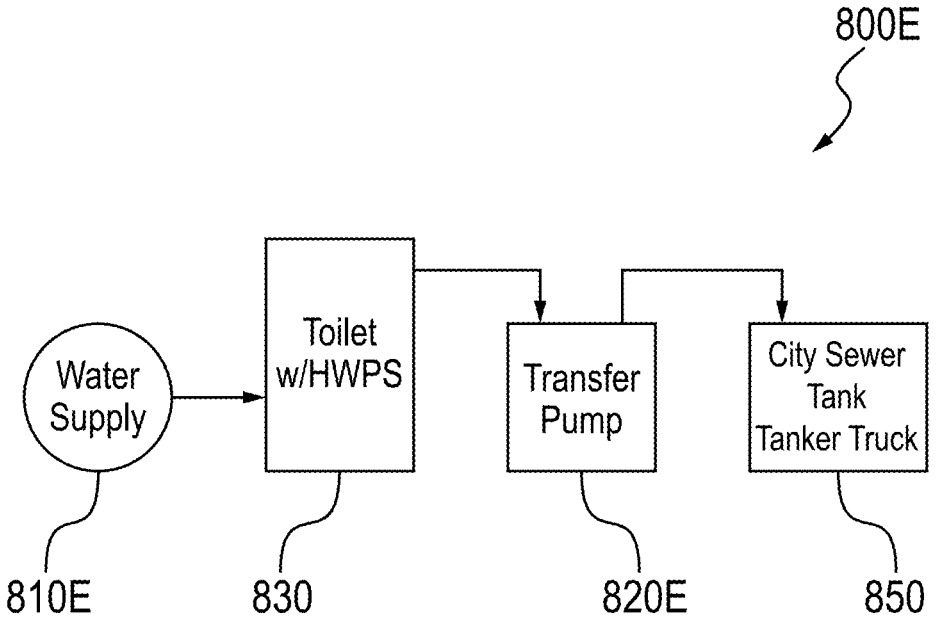
FIG. 8E is a fifth schematic view of a self-contained sanitation system wherein the toilet uses the human waste propulsion system of the present invention. Here, the human waste moves into a transfer pump upon flushing. The human waste is then pumped into the tank of a permitted tanker truck for transport to a municipal processing plant, or may go directly into the municipal sewer system.

Finally, FIG. 8E is a schematic view of a self-contained sanitation system 800E in a fifth embodiment. The system 800E is intended to be agnostic in terms of the source of water 810E. Water from any available source is moved into the toilet unit 830. Upon activation of the flushing mechanism, human waste and water are moved through a transfer pump 820E. The transfer pump 820E pumps the human waste and water into the tank 850 of a permitted tanker truck for transport to a municipal processing plant, or may go directly into the city sewer system.

The arrangement of FIG. 8E would be of particular benefit when a plurality of toilet units 830 are provided in a public location associated with a venue. Examples may include a concert, a fair or a sporting event. Additional examples include off-grid housing such as oilfield man camps, remote military camps, and refugee camps.

Figure 9:
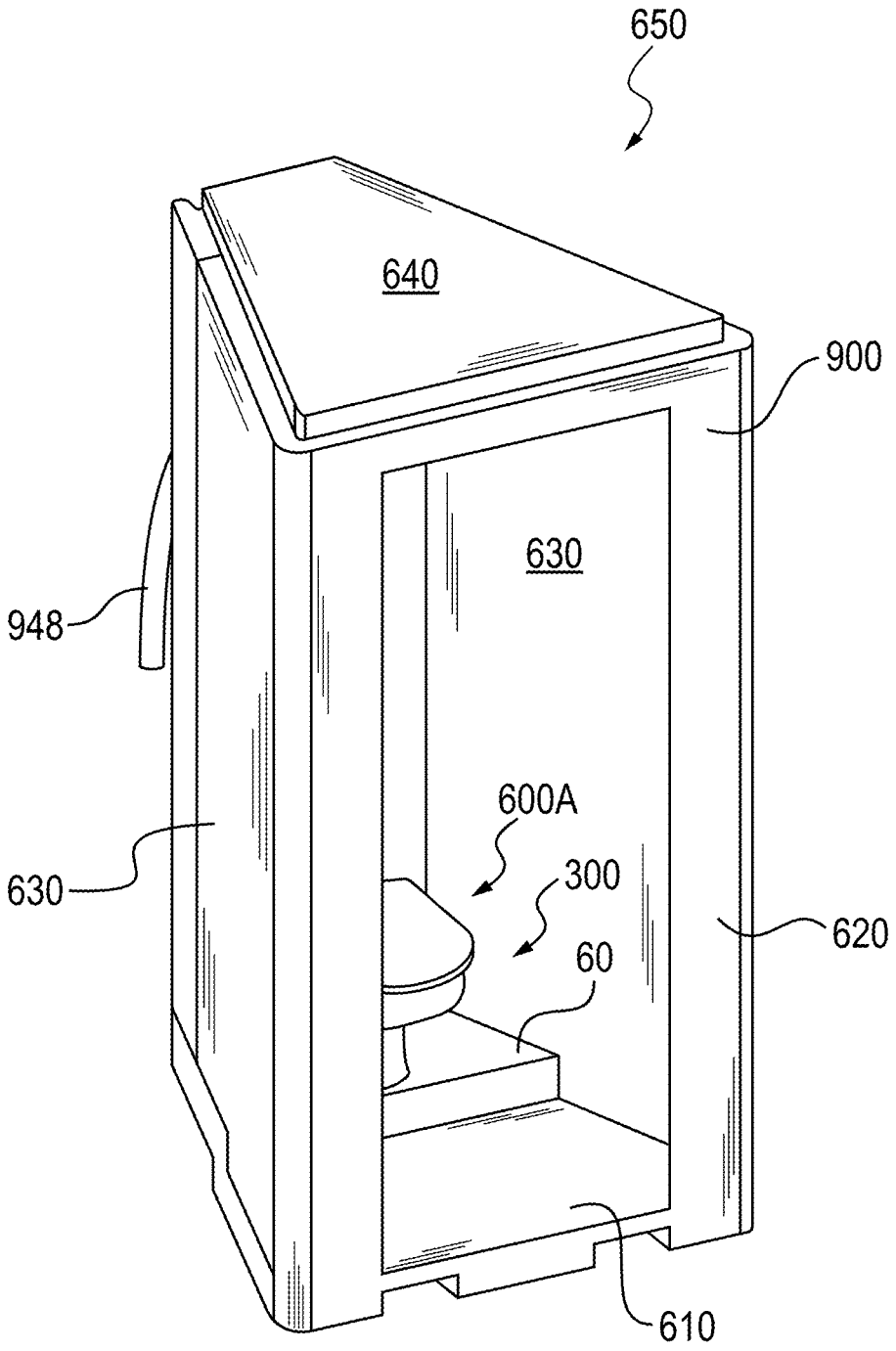
FIG. 9 is a perspective view of a portion of the human waste propulsion system of FIG. 6A. Here, the toilet is residing within a portable toilet unit.

FIG. 9 is a perspective view of a toilet unit 900. The toilet unit 900 is an illustrative toilet unit as may be used in connection with any of the self-contained sanitation systems of FIGS. 8A through 8E. Residing within the toilet unit 900 is a human waste propulsion system in accordance with the human waste propulsion system 600A.

The toilet 300 of the human waste propulsion system 600A is positioned on a deck 60. The deck 60, in turn, resides on a flooring 610 for the toilet unit 900. The toilet unit 900 includes a partial front panel 620 and side walls 630. It is understood that the front panel 620 will have a door (such as door 625 of FIG. 10A) held in place through a hinged connection. The toilet unit 900 also includes a ceiling 640, thus forming a port-a-potty 650. The enclosed port-a-potty 650 may include additional components, such as air vents.

Of interest, a waste release tubing 948 is shown. In this arrangement, the waste release tubing 948 is intended to deliver black water and human waste into a transfer pump (shown in FIG. 8E at 820E) in response to the flushing of the toilet 300.

It is observed that the port-a-potty 650 has a trapezoidal profile. In this arrangement, a series of port-a-potties 650 can be placed side-by-side, forming a closed toilet system. The closed toilet system may be comprised of a plurality of port-a-potties 650 forming a polygonal shape.

Figure 10A:
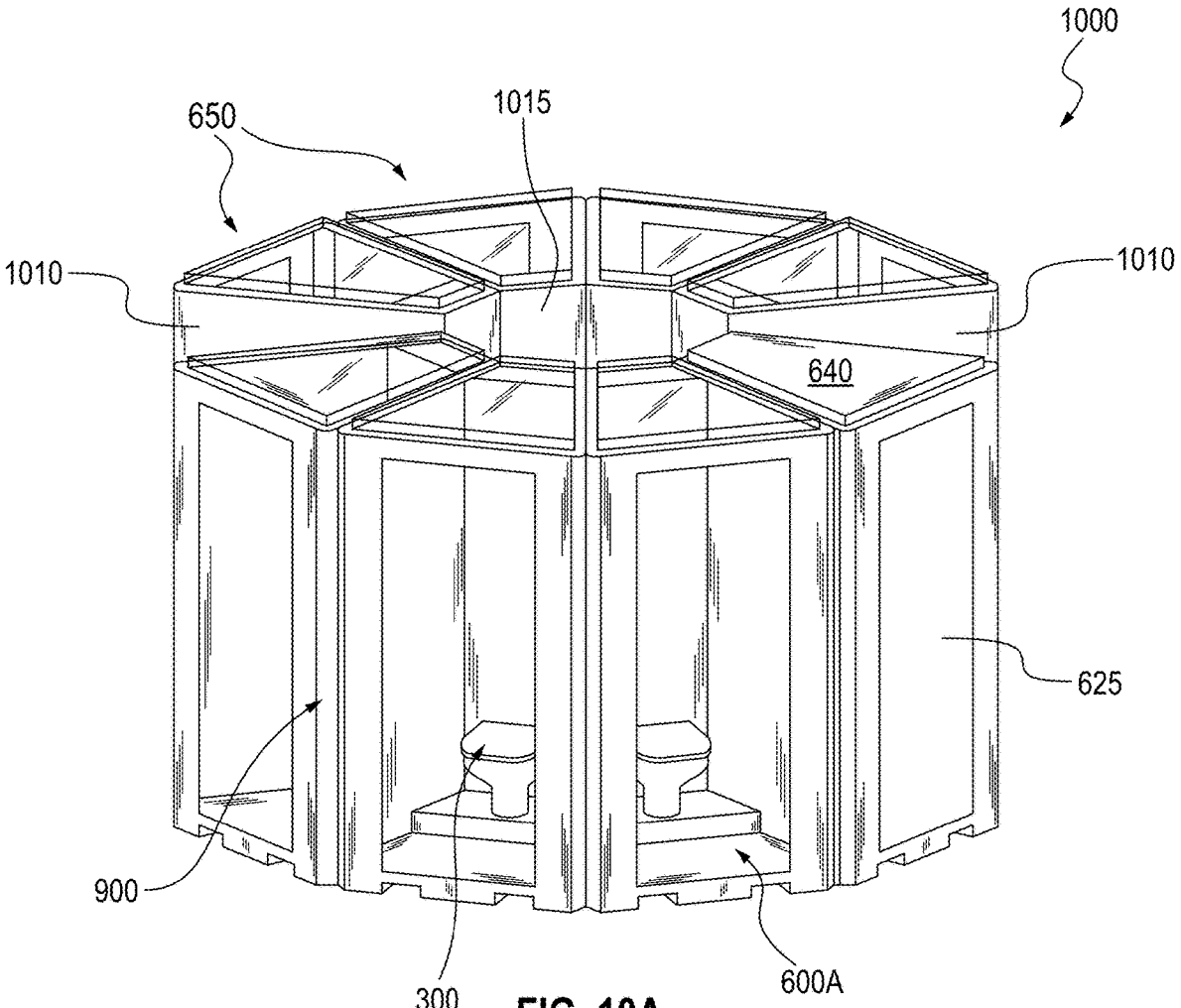
FIG. 10A is a first perspective view of a series of portable toilet units in accordance with the human waste propulsion system of FIG. 6A. Each portable toilet unit contains a toilet, which is controlled using a waste propulsion system. The portable toilet units are configured to be placed in side-to-side orientation, forming a pod.

FIG. 10A is a first perspective view of a series of portable toilet units 900 having been placed in such a side-by-side arrangement. Each portable toilet unit 900 contains a toilet 300 which is controlled using the human waste propulsion system 600A. The portable toilet units 900 are configured to form a substantially closed toilet system 1000, referred to as a pod.

In the view of FIG. 10A, two slots 1010 are left empty. This gives an operator the ability to access the respective waste release tubes 948 and a transfer pump 820E. The waste release tubes 948 extends from a back side 670 of each port-a-potty 650 into an inner location 1015. Similarly, and as shown in FIG. 10C, the inner location 1015 holds a manifold 1020. The manifold 1020 serves as a central collection location for water and human waste as it is flushed out of the toilets 300. The pump shown in FIG. 10C as sump pump 1060 serves as the transfer pump.

The closed toilet system 1000 may be utilized at locations in which fixed and plumbed bathrooms are not available or practicable. The closed toilet system 1000 may be utilized at locations such as outdoor concerts, festivals and sporting events. The closed toilet system 1000 may also have utility at construction or other outdoor job sites. A series of the individual portable toilet units 900 may be delivered to the desired location and later removed from the location. The portable toilet units 900 may each contain a door 625 for ingress and egress to individual toilet units 830 along with the floor 610, the front panel 620, the walls 630, the ceiling 640, and several vents (not shown). For most units 900, the ceiling 640 is removed for illustrative purposes.

In one aspect, through-openings are provided along the sides of the flooring of each toilet unit 900. One through-opening 632 receives conduits for potable water; one through-opening 634 receives conduits for wiring; and one through-opening 636 receives conduits for a pneumatic hose. All conduits originate from equipment residing in the inner location 1015.

The individual portable toilet units 900 face outward from an inner location 1015. Within the inner location 1015, various components may be positioned to include the respective waste release tube (shown at 948 in FIG. 9 and FIG. 10C) and transfer pump 820E. In addition, the inner location 1015 may include tools and control equipment.

Figure 10B:
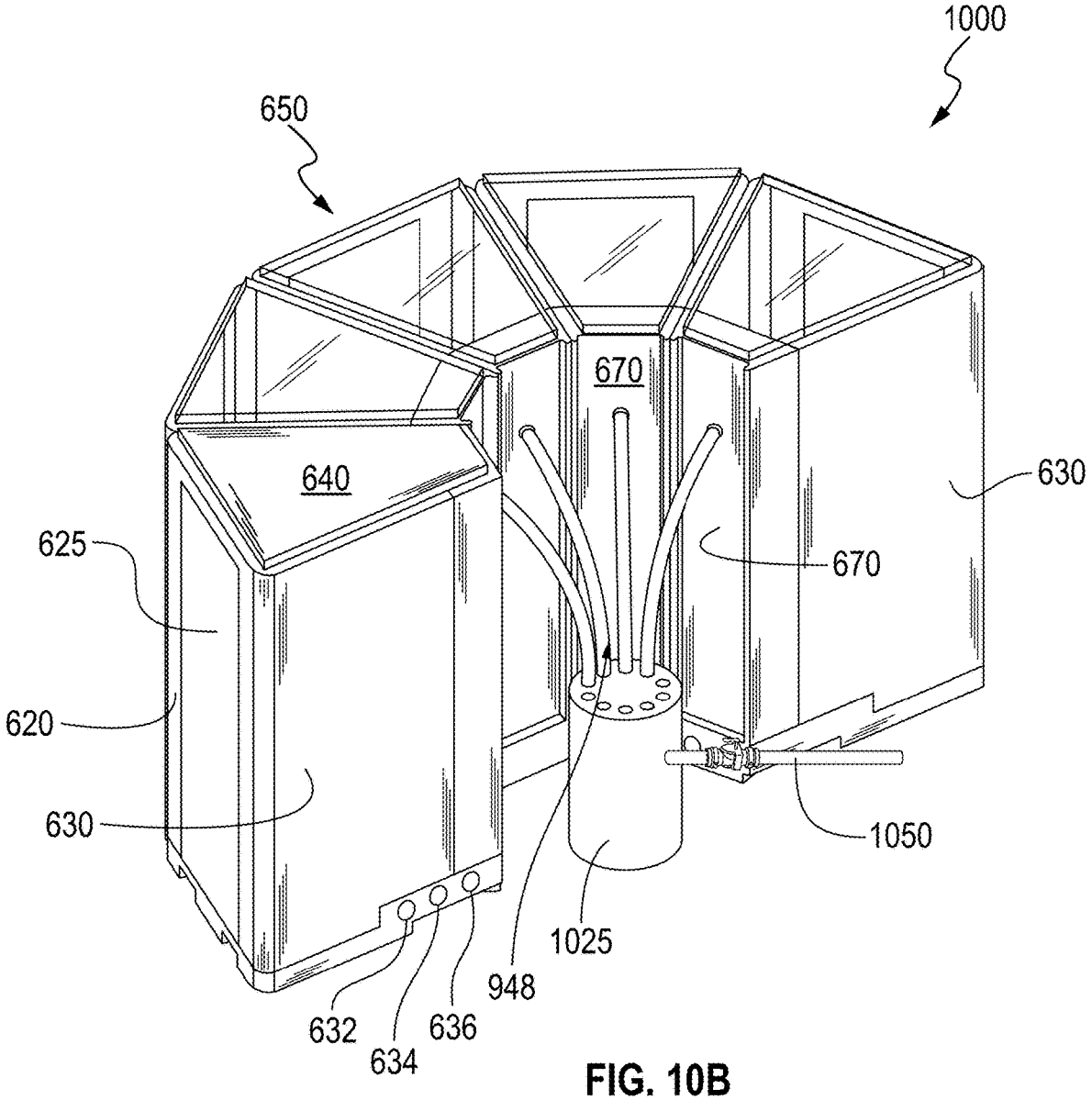
FIG. 10B is a cut-away perspective view of the portable toilet units of FIG. 10A. A manifold is visible within a central opening formed by the closed polygonal arrangement. A series of drain tubes is seen collected at the manifold.
Figure 10C:
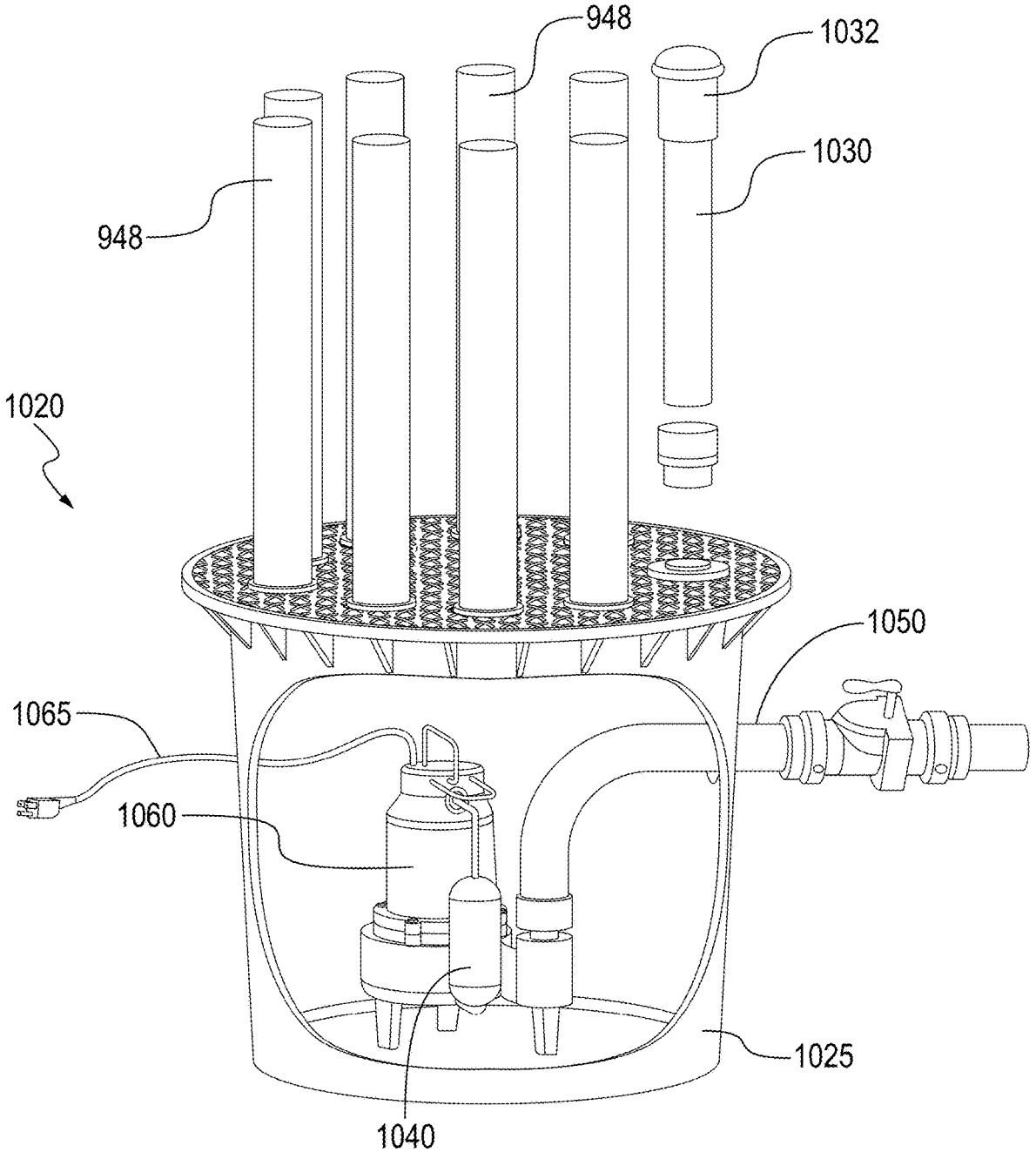
FIG. 10C is a cut-away perspective view of the manifold of FIG. 10B, in one illustrative embodiment. A series of waste release tubes is seen entering the manifold. In addition, a vent tube is seen extending from the manifold.

FIG. 10B is a cut-away perspective view of the closed toilet system 1000 of FIG. 10A. Four of the port-a-potties 650 have been removed for illustrative purposes, leaving the inner location 1015 exposed.

A plurality of waste release tubes 948 are seen. Each waste release tube 948 extends out of a respective back wall 670 of a port-a-potty 650. Each waste release tube 948 then feeds into a manifold 1020. The water and human waste may then be released directly into the city sewage system (shown at 845 of FIGS. 8C and 8D). Alternatively, the water and human waste may be directed into a pump (such as transfer pump 820E shown in FIG. 8E). Alternatively still, the water and human waste may be released into a tank or tank truck (shown at 850 of FIG. 8E). In a preferred embodiment, the manifold 1020 has its own sump pump. The sump pump is preferably a so-called grinder pump.

FIG. 10C is a cut-away perspective view of an illustrative manifold 1020 as may be located in the inner location 1015 formed by the polygonal configuration of the closed toilet system 1000 of FIG. 10A. The manifold 1020 includes a cylindrical housing 1025. The cylindrical housing 1025 receives waste from the respective waste release tubes 948 of the toilets 300.

Residing within the cylindrical housing 1025 is a float valve 1040. As is known in the art, the float valve 1040 moves up and down within the cylindrical housing 1025 in accordance with the level of fluid contained therein.

Also residing within the cylindrical housing 1025 is a sump pump 1060. When the fluid within the cylindrical housing 1025 reaches a designated level, the float valve 1040 will send a signal to the sump pump 1060 to activate. This causes fluids within the cylindrical housing 1025 to be pumped out of the cylindrical housing 1025 by the sump pump 1060.

Extending from the cylindrical housing 1025 is a drain tube 1050. The drain tube 1050 functions to receive water and human waste from the sump pump 1060 when the sump pump 1060 is activated. The drain tube 1050 then directs fluids to a collection location. The collection location is preferably a tank or tank truck as shown at 850 of FIG. 8E). Alternatively, the sump pump 1060 may be manually operated to evacuate the cylindrical housing 1025 of the human waste and water. This operation may be undertaken prior to the removal of the closed toilet system 1000 from its location.

When the level of human waste and water has decreased to a certain point, the float valve 1040 will sense the level and send a signal to the sump pump 1060. When the pump 1060 receives this signal, it will cease operation. Of course, the sump pump 1060 may also be operated manually via a user input.

It is preferred that the sump pump 1060 be electrically powered. To this end, a power cable 1065 is provided. The power cable 1065 supplies power to the sump pump 1060 from either an electrical grid or from a battery or generator. Additionally, the manifold 1020 may include a vent tube 1030. The vent tube 1030 functions to discharge gaseous fluids from the manifold 1020. The vent tube 1030 may be configured to discharge gaseous fluids to the holding tank or to the atmosphere. Optionally, a charcoal filter 1032 may be provided at the discharge end of the vent tube 1030.

Figure 10D:
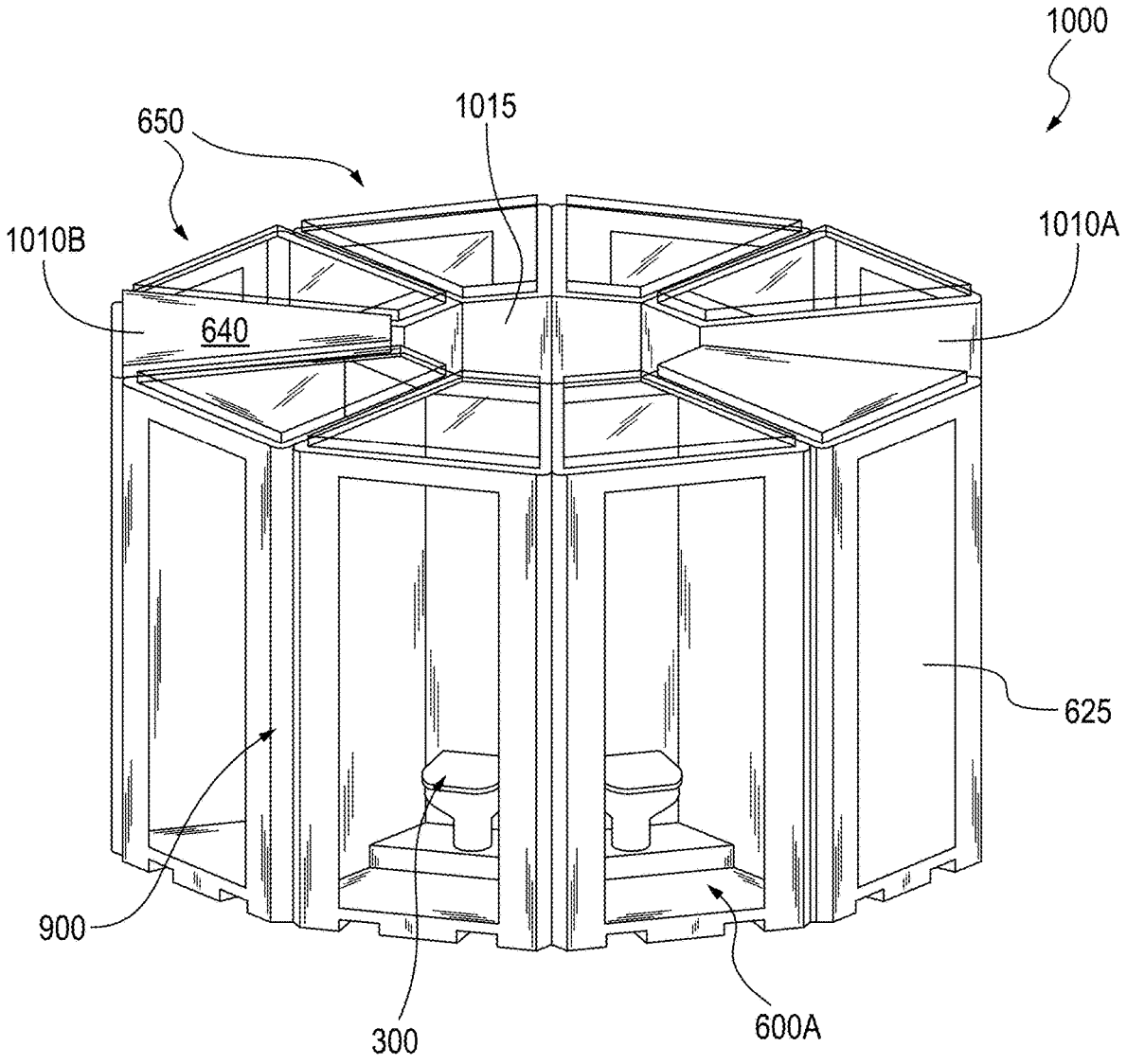
FIG. 10D is a second perspective view of a series of portable toilet units having been placed in such a side-by-side arrangement. One open slot has been reserved for access into an inner location while a second slot is used to hold equipment. This is an alternative to the pod arrangement of FIG. 10A.

In an alternative arrangement of the pod 1000 of FIG. 10A, one slot 1010A is left empty while the other receives a utility closet 1010B. FIG. 10D shows this arrangement. Specifically, FIG. 10D is a second perspective view of a series of portable toilet units 900 having been placed in such a side-by-side arrangement. Slot 1010A has been reserved for access into the inner location 1015 while slot 1010B is used to hold equipment. Such equipment may include one or more batteries for power, a controller, a compressor sized to handle the toilets in the eight port-a-potties 650, a water pump and an AC/DC converter. In this instance, all conduits originate from equipment residing in the utility closet 1010B.

Figure 11:
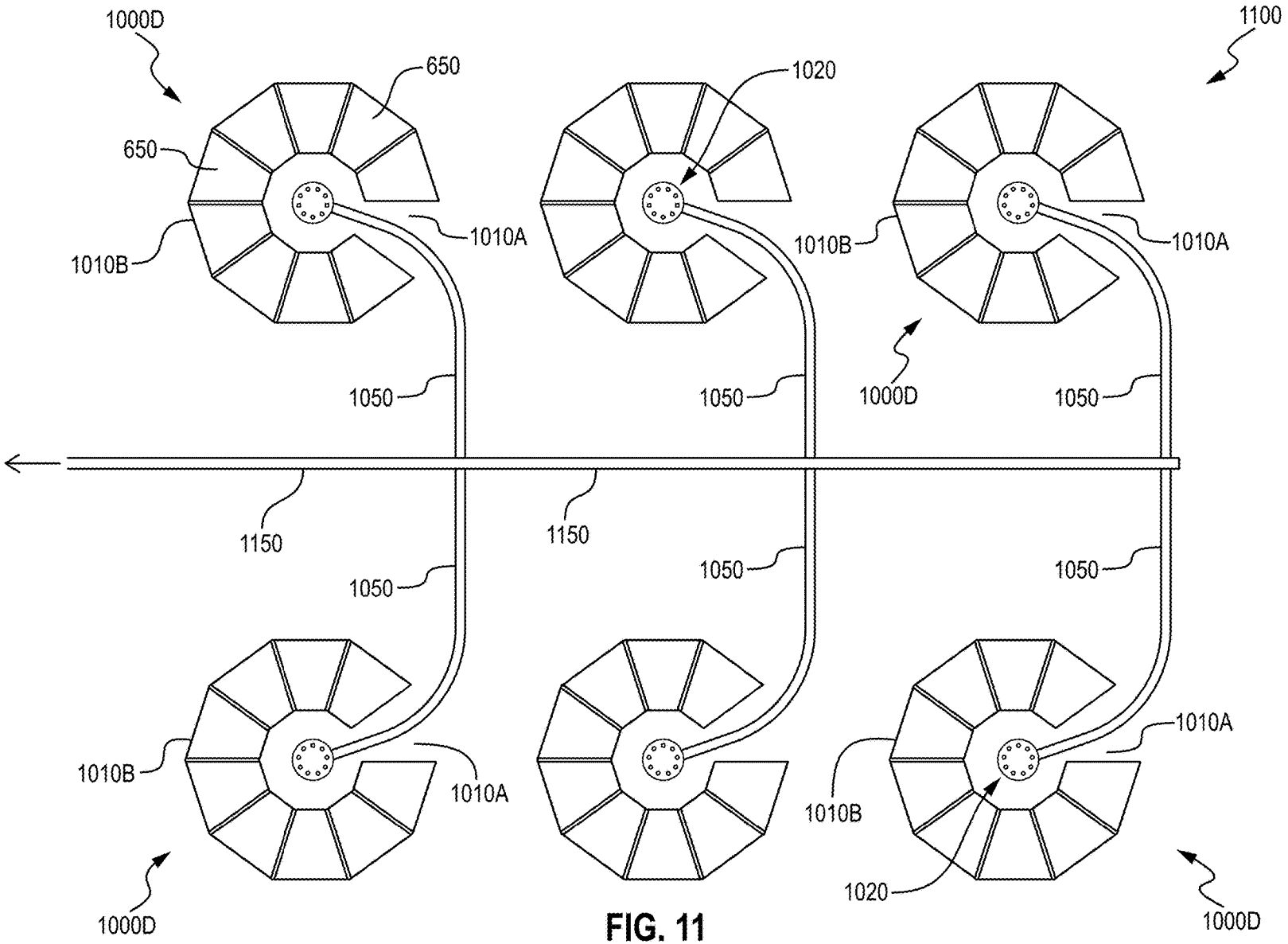
FIG. 11 is a schematic view of a series of pods placed in proximity to one another. The drain tubes of each pod are directed to a waste truck for transport and disposal.

FIG. 11 is a schematic view of series of pods 1000D placed in proximity to one another. The pods 1000D are placed at an off-grid location 1100. The off-grid location 1100 may be, for example, a concert, a fair ground, a military camp, a remote research facility, or a refugee camp.

Each pod 1000D is shaped as a decagon in accordance with the illustrative pod 1000D of FIG. 10D. A series of adjacent port-a-potties 650 is provided for each pod 1000D. In addition, one slot 1010A is reserved as an opening for access to the inner location 1015.

As described above, one slot for a port-a-potty does not have a toilet; instead, the walls 630 and door 625 for what would otherwise have been a port-a-potty 650 is employed as a utility closet 1010B. Extending out of each utility closet 1010B of each pod 1000D is a drain tube 1050. The drain tube 1050 receives black water (water and human waste) expelled after a flushing event. The respective drain tubes 1050 direct the black water to a trunk line 1150.

The trunk line 1150 delivers black water to a collection location. The collection location is preferably a tank or tank truck as shown at 850 of FIG. 8E. In this manner, black water may be collected and transported away from the location 1100 and taken to a water purification facility or dumped into a sewer line.

As can be seen, an improved human waste propulsion system is provided. The system may be used with an RV or other travel vehicle. Alternatively, the system may be used with an airplane or a marine vessel. Alternatively still, the system may be used in a portable configuration as a desired location, such as a job site, concert, fair, festival, or sporting event. The advantages detailed above make the device more compact, powerful, and efficient than any approach heretofore offered.

In addition, a plurality of portable toilet units is provided, wherein each portable toilet unit has the profile of a polygon, such as an isosceles trapezoid. The portable toilet units are placed in side-by-side relation, forming a closed, or substantially closed, geometrical shape. Each portable toilet comprises:

a toilet having a bowl, and a seat residing above the bowl;

a hydraulic flushing mechanism associated with the toilet;

a bottom drain (or fluid receiving chamber) fluidically connected to the toilet below the bowl, with the fluid receiving chamber being configured to gravitationally receive human waste that passes through the bowl;

a pneumatic line in fluid communication with the fluid receiving chamber proximate the bowl;

an air source configured to supply compressed air to the pneumatic line; and a controller configured to direct the compressed air into the pneumatic line when the flushing mechanism is actuated, thereby moving human waste through the bottom drain.

As noted above, the human waste propulsion system may be incorporated into any portable or fixed toilet that resides at a remote location, or that is not plumbed directly into a municipal sewer system, or that is not hooked into a municipal water supply. Examples include a sanitation facility at a park or at a nature preserve. Additional examples include (i) a so-called tiny-house, (ii) a mobile home, (iii) a living unit in a man camp, or (v) a dog house, i.e., a shelter located at a remote working facility such as in an oil field.

The present disclosure is not to be limited in terms of the particular embodiments described in this application, which are intended as illustrations of various aspects. Many modifications and variations can be made without departing from its spirit and scope of the application and present technology. Functionally equivalent methods and systems within the scope of the disclosure, in addition to those enumerated herein, are possible from the foregoing descriptions. The terminology used herein is for the purpose of describing particular embodiments only, and is not intended to be limiting.

I claim:

1. A human waste propulsion system, comprising:

a toilet having a bowl, and a seat residing above the bowl;

a hydraulic flushing mechanism associated with the toilet;

a fluid receiving chamber fluidically connected to the toilet below the bowl, with the fluid receiving chamber being configured to gravitationally receive human waste that passes through the bowl;

a pneumatic line in fluid communication with the fluid receiving chamber below the bowl;

a source of compressed air configured to supply air to the pneumatic line under pressure;

an air valve residing along the pneumatic line; and a controller configured to open the air valve when the hydraulic flushing mechanism is actuated, and direct a pulse of compressed air into the pneumatic line, thereby moving human waste through the fluid receiving chamber;

and wherein the fluid receiving chamber comprises:

a flush valve below the bowl;

a point of connection with the pneumatic line below the flush valve;

a U-shaped profile below both the flush valve and below the point of connection with the pneumatic line, wherein the U-shaped profile comprises:

an upper receiving end at an upstream side of the U-shaped profile;

a sewage ejection pipe extending at a downstream side of the U-shaped profile and configured to expel the human waste when the hydraulic flushing mechanism is actuated; and a reducer residing between the upper receiving end and the downstream sewage ejection pipe;

and wherein:

a diameter of the upper receiving end is twice the size of a diameter of the downstream sewage ejection pipe;

the reducer is eccentric, such that the downstream sewage ejection pipe connects to the reducer at a bottom end of the U-shaped profile; and an interior volume of the fluid receiving chamber matches a water volume for one flush of the toilet.

2. The human waste propulsion system of claim 1, further comprising:

a fluid processing unit, wherein the fluid processing unit comprises:

a source of water; and a black water receptacle configured to receive the human waste from the fluid receiving chamber when the hydraulic flushing mechanism is actuated and the human waste is expelled.

3. The human waste propulsion system of claim 2, wherein:

the source of compressed air is an air tank holding compressed air, or a compressor;

the source of water is a municipal water line, or a potable water tank connected to a water pump configured to move water into the bowl of the toilet when the hydraulic flushing mechanism is actuated; and the black water receptacle is a public sewer line, a septic tank, a free-standing water treatment system, a sewage tank on a truck, or a black water tank;

and wherein the pneumatic line injects air into the fluid receiving chamber in a direction that is orthogonal to a flow plane of the human waste.

4. The human waste propulsion system of claim 3, further comprising:

a vent tube fluidically connected to the fluid receiving chamber proximate the pneumatic line.

5. The human waste propulsion system of claim 3 further comprising:

a water valve in fluid communication with the source of water;

and wherein:

the air valve is normally closed;

the water valve is normally closed;

the flush valve is normally closed; and the controller is programmed to (i) open the water valve and the flush valve when the hydraulic flushing mechanism is actuated, then (ii) close the water valve and the flush valve, and then (iii) open the air valve to deliver a pulse of air into the fluid receiving chamber to expel the human waste.

6. The human waste propulsion system of claim 5, wherein:

the sewage ejection pipe extends to a height above the seat.

7. The human waste propulsion system of claim 6, further comprising:

a water line extending from the source of water, wherein the water valve resides along the water line;

and wherein:

the toilet further comprises a base;

each of the air valve and the water valve is a solenoid valve;

the hydraulic flushing mechanism is a foot pedal residing along the base or a push-button residing above the seat; and the water valve remains open after the hydraulic flushing mechanism is actuated (i) for so long as the hydraulic flushing mechanism is actuated, or (ii) for a pre-selected time.

8. The human waste propulsion system of claim 7, wherein:

the base resides on a flooring; and (i) the fluid receiving chamber resides within the base and above the flooring, or (ii) the fluid receiving chamber resides below the base and below the flooring.

9. The human waste propulsion system of claim 7, wherein:

the sewage ejection pipe delivers human waste to a collection tank; and the human waste propulsion system resides within a module.

10. The human waste propulsion system of claim 9, wherein:

the module comprises a port-a-potty;

the black water receptacle is a black-water tank; and the black water tank is a portable container, or resides on a tanker truck.

11. The human waste propulsion system of claim 9, wherein the module resides within (i) a park, or (ii) a remote camp.

12. The human waste propulsion system of claim 9, wherein the water line receives water from a water tank or from a municipal water source.

13. The human waste propulsion system of claim 9, wherein the base is secured to a chassis or frame of a vehicle or vessel.

14. The human waste propulsion system of claim 9, wherein:

the base is secured to a chassis or frame of a vehicle; and the vehicle is a recreational vehicle, a passenger bus, or a rail car.

15. The human waste propulsion system of claim 9, further comprising:

a check valve residing along the sewage ejection pipe.

* * * * *